US009459551B2

(12) United States Patent
Hasegawa

(10) Patent No.: US 9,459,551 B2
(45) Date of Patent: Oct. 4, 2016

(54) IMAGE FORMING APPARATUS

(71) Applicant: CANON KABUSHIKI KAISHA, Tokyo (JP)

(72) Inventor: Hideaki Hasegawa, Yorktown, VA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/861,770

(22) Filed: Sep. 22, 2015

(65) Prior Publication Data

US 2016/0097988 A1 Apr. 7, 2016

(30) Foreign Application Priority Data

Oct. 1, 2014 (JP) ..... 2014-203415

(51) Int. Cl.
*G03G 15/01* (2006.01)
*G03G 15/02* (2006.01)

(52) U.S. Cl.
CPC ..... *G03G 15/0266* (2013.01)

(58) Field of Classification Search
CPC ..... G03G 15/5058; G03G 2215/0161; G03G 15/0189; G03G 2215/0158; G03G 15/013
USPC ..... 399/301
See application file for complete search history.

(56) References Cited

U.S. PATENT DOCUMENTS

2002/0127026 A1* 9/2002 Kubota ..... G03G 15/5037 399/48
2006/0008285 A1* 1/2006 Yoshizuka ..... G03G 15/553 399/49
2009/0067864 A1* 3/2009 Shirafuji ..... G03G 15/161 399/66
2013/0195475 A1* 8/2013 Kubo ..... G03G 15/553 399/26
2013/0202321 A1* 8/2013 Suhara ..... G03G 15/043 399/48
2013/0279921 A1* 10/2013 Kanai ..... G03G 15/50 399/12

FOREIGN PATENT DOCUMENTS

JP 7-234612 A 9/1995
JP 2000-218860 A 8/2000
JP 2007-187734 A 7/2007
JP 2012-141587 A 7/2012
JP 2013-156549 A 8/2013

OTHER PUBLICATIONS

Machine translation of Tsuruya JP 2012/141587 , publication date.*

* cited by examiner

*Primary Examiner* — Walter L Lindsay, Jr.
*Assistant Examiner* — Frederick Wenderoth
(74) *Attorney, Agent, or Firm* — Canon U.S.A. Inc., IP Division

(57) ABSTRACT

An image forming apparatus includes a photosensitive member, an exposure device, a detection device, a measurement device that measures a current flowing to the detection device, and a control unit that executes a detection mode in which an electrostatic latent image is formed on the photosensitive member and the measurement device detects a change in the current relative to the electrostatic latent image, wherein, in an adjustment mode, the control unit causes a potential difference between the electrostatic latent image and the detection device to be smaller as a layer thickness of the photosensitive member is more reduced.

29 Claims, 11 Drawing Sheets

IMAGE FORMING APPARATUS

BACKGROUND

1. Field

Aspects of the present invention generally relate to an image forming apparatus, such as a copier and a printer, that generally employs an electrophotographic method.

2. Description of the Related Art

A color image forming apparatus employing an electrophotographic method includes image forming units that are independently arranged for respective colors to accelerate print processing. Images are sequentially transferred from the image forming units of the respective colors to an intermediate transfer belt. Then, the images are collectively transferred from the intermediate transfer belt to a transfer medium.

In the color image forming apparatus with such a known configuration, color misregistration (misregistration of toner images of the respective colors) can occur due to mechanical factors provided in the image forming units of the respective colors. The color misregistration occurs when the images are superimposed. Particularly, in a case where laser scanners (optical scanning devices and exposure devices) and photosensitive drums are independently arranged relative to the image forming units of the respective colors, positional relations between the laser scanners and the photosensitive drums differ on a color basis. Consequently, laser scanning positions on the photosensitive drums cannot be synchronized, causing the color misregistration.

Among factors in the color misregistration, one of the most influential factors is fluctuations in laser irradiation position on the photosensitive drum due to thermal deformation of an optical unit. Generally, the optical unit deflects a laser beam emitted from a light source with a rotating polygon mirror to perform scanning. Between the emission of the laser beam from the light source to the arrival of the laser beam to the photosensitive drum, an optical element allows the laser beam to reflect on mirrors for several times to change a travelling direction of the laser beam, or adjusts a spot and a scanning width of the laser beam via a lens. Such an optical element determining an optical path for the laser beam is fixed to a frame of the optical unit. In a case where the frame is thermally deformed due to a temperature rise with operations of the image forming apparatus, a position of the optical element changes. This affects a direction of the optical path. Since a change in the optical path direction increases in proportion to a length of the optical path to the photosensitive drum, such a change appears as the fluctuations in the irradiation position even if the frame deformation of the optical unit is extremely small.

Such an image forming apparatus performs color misregistration correction control to correct the color misregistration. Japanese Patent Application Laid-Open No. 7-234612 discusses color misregistration correction control in which a detection toner image of each color is transferred from a photosensitive drum to an image bearing member (e.g., an intermediate transfer belt), and relative positions of the detection toner image in a scanning direction and a conveyance direction are detected by an optical sensor. Accordingly, the color misregistration is controlled based on the relative positions detected by the optical sensor.

Moreover, Japanese Patent Application Laid-Open No. 2000-218860 discusses laser irradiation position correction in which a temperature rise inside an image forming apparatus or a temperature of an optical unit is detected by a temperature sensor and a laser irradiation position is corrected by a correction controller.

According to each of such kinds of color misregistration correction control, however, the detection toner image is transferred from the photosensitive drum to the image bearing member (e.g., an intermediate transfer belt). This degrades usability of the image forming apparatus in terms of toner consumption and time necessary to clean the image bearing member, for example. Accordingly, Japanese Patent Application Laid-Open No. 2012-141587 discusses color misregistration correction control in which fluctuations in current value are detected, the current value fluctuations occurring when a detection electrostatic latent image formed on a photosensitive drum reaches a process unit. Thus, the color misregistration is controlled based on the detected current value fluctuations.

However, in the image forming apparatus forming the detection electrostatic latent image on the photosensitive drum to perform the color misregistration correction control (adjustment of light emission timing of an exposure device), the photosensitive drum is repeatedly exposed to the light for long periods. This may deteriorate sensitivity due to light-induced fatigue, and cause generation of a poor-quality image such as a decrease in image density.

Moreover, in a high-speed compact color image forming apparatus, thermal deformation of an optical unit is more noticeable. Thus, frequency of color misregistration correction needs to be increased. This causes difficulty in extending life span of a photosensitive drum.

SUMMARY

Aspects of the present invention are generally directed to an image forming apparatus capable of forming an electrostatic latent image for detection while suppressing deterioration in sensitivity of a photosensitive drum.

According to an aspect of the present invention, an image forming apparatus forming an image on a recording medium includes a photosensitive member configured to be rotated, an exposure device configured to expose the photosensitive member to light to form an electrostatic latent image on the photosensitive member, a detection device to which a voltage is applied, a measurement device configured to measure a current flowing to the detection device, and a control unit configured to execute a detection mode in which an electrostatic latent image is formed on the photosensitive member and the measurement device detects a change in the current relative to the electrostatic latent image, wherein, in the detection mode, the control unit causes a potential difference between the electrostatic latent image and the detection device to be smaller as a layer thickness of the photosensitive member is more reduced.

Further features of the present disclosure will become apparent from the following description of exemplary embodiments with reference to the attached drawings.

DESCRIPTION OF THE EMBODIMENTS

Hereinafter, exemplary embodiments are described in detail with reference to the drawings. Sizes, materials, shapes, and relative arrangements of components described in the exemplary embodiments can be appropriately changed according to various conditions and a configuration of an apparatus to which aspects of the present invention are applied. That is, the scope of aspects of the present invention is not limited to the following exemplary embodiments.

(1-1) Description of Overall Configuration of Image Forming Apparatus

Figure 2:
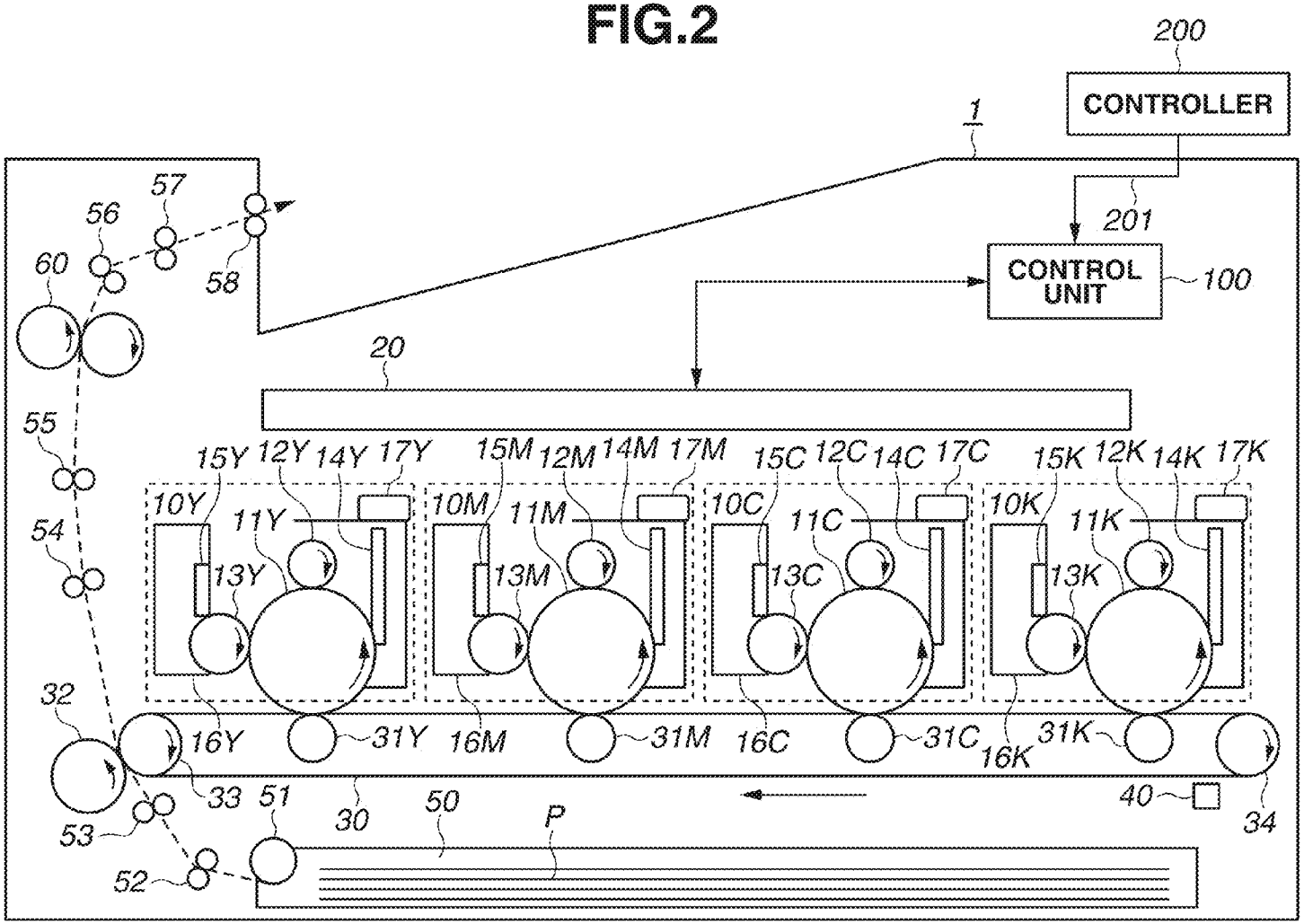
FIG. 2 is a schematic sectional view illustrating an image forming apparatus according to the exemplary embodiment.

FIG. 2 is a schematic sectional view illustrating an image forming apparatus 1 according to a first exemplary embodiment. The image forming apparatus 1 serves as a laser beam printer employing an electrophotographic process. The image forming apparatus 1 includes a printer control unit (hereinafter called a control unit) 100 connected to a printer controller (an external host device) 220 via an interface 201. The image forming apparatus 1 forms an image corresponding to image data (electrical image information) on a sheet P serving as a recording medium, the image data being input from the printer controller (hereinafter called a controller) 200. Subsequently, the image forming apparatus 1 outputs the sheet P with the image as an image formed product (in a normal image forming operation, an image is formed on a sheet based on image data and the resultant sheet is output). The control unit 100 controls operations of the image forming apparatus 1, and exchanges various electrical information signals with the controller 200. Moreover, the control unit 100 performs processing of electrical information signals input from various process devices and sensors, processing of command signals to the various process devices, predetermined initial sequence control, and predetermined image forming sequence control. The controller 200 is, for example, a host computer, a network, an image reader, and a facsimile. For example, the sheet P is recording paper, an overhead projector (OHP) sheet, a postcard, an envelope, and a label.

The image forming apparatus 1 illustrated in FIG. 2 includes four image forming units (process cartridges) 10Y, 10M, 10C, and 10K that are arranged parallel to one another in a lateral direction (a substantially horizontal direction) with a certain distance therebetween. That is, the image forming apparatus 1 is what is called an in-line type image forming apparatus. Although suffixes Y, M, C, and K (indicating yellow, magenta, cyan, and black, respectively) of the process cartridges 10Y, 10M, 10C and 10K indicate that different colors of developer are stored therein (toner images of different colors are to be formed), the process cartridges 10Y, 10M, 10C, and 10K are configured substantially similar to one another. In the descriptions below, the color abbreviations in the respective process cartridges 10Y, 10M, 10C, and 10K, and configurations therein or configurations corresponding thereto may be omitted if a description of color difference is not needed.

The process cartridges 10Y, 10M, 10C, and 10K respectively include photosensitive drums 11Y, 11M, 11C and 11K, charging rollers 12Y, 12M, 12C, and 12K, developing rollers 13Y, 13M, 13C, and 13K, developing blades 15Y, 15M, 15C, and 15K, and drum cleaners 14Y, 14M, 14C, and 14K. In each of the process cartridges 10, the photosensitive drum 11, the charging roller 12, the developing roller 13, the developing blade 15, and the drum cleaner 14 are integrally arranged. The charging roller 12 serving as a charging unit (a charging device, a charging member) uniformly charges a surface of the photosensitive drum 11 serving as an image bearing member with a predetermined potential. The developing roller 13 serving as a developing unit bears and conveys non-magnetic one component toner (a negative charge characteristic) to develop an electrostatic latent image formed on the photosensitive drum 11 into a developer image (a toner image). Moreover, the developing roller 13 serves as a developer bearing member for bearing developer. The developing blade 15 uniforms a thickness of a toner layer on the developing roller 13. The drum cleaner 14 cleans the surface of the photosensitive drum 11 after a toner image is transferred from the photosensitive drum 11. The photosensitive drum 11 is rotated by a drive unit (not illustrated) at a surface movement speed (a process speed) of 120 (mm/sec) in a direction indicated by an arrow shown in FIG. 2. The photosensitive drum 11 includes a charge generation layer, a charge transport layer, and a surface layer that are sequentially laminated on an aluminum pipe. In the present exemplary embodiment, the charge generation layer, the charge transport layer, and the surface layer are collectively described as a photosensitive layer.

Here, the process cartridges 10Y, 10M, 10C, and 10K are substantially similar to one another except for toner stored in respective developer containers 16Y, 16M, 16C and 16K. The process cartridges 10Y, 10M, 10C, and 10K form respective toner images of yellow (Y), magenta (M), cyan (C), and black (K). Moreover, each of the process cartridges 10Y, 10M, 10C, and 10K is detachable from a body of the image forming apparatus 1. For example, when the toner inside the developer container 16 runs out, the corresponding process cartridge 10 can be replaced. Such replacement can be performed on a process cartridge basis.

The process cartridges 10Y, 10M, 10C, and 10K include respective memories 17Y, 17M, 17C, and 17K serving as storage units (storage members). As for the memory 17, for example, an optional type such as a contact non-volatile memory, a non-contact non-volatile memory, and a volatile memory including a power source can be used. In the present exemplary embodiment, the non-contact non-volatile memory serving as a storage unit is installed as the memory 17 in the process cartridge 10. Such a non-contact non-volatile memory 17 includes an antenna (not illustrated) serving as an information transmission unit on the memory side to wirelessly communicate with the control unit 100 on the image forming apparatus 1 side, so that information can be read and written. That is, the control unit 100 serves as an information transmission unit on the apparatus body side, and has functions of reading and writing information relative to the memory 17.

The memory 17 stores information about a photosensitive drum at the time of being new. For example, the information includes a photosensitive layer thickness (an initial thickness of the photosensitive layer, an initial layer-thickness) provided when the photosensitive drum is new, and a sensitivity (an initial sensitivity) provided when the photosensitive drum is new. Such information is stored when the image forming apparatus 1 is manufactured. Moreover, photosensitive member information (information about amounts of changes in the photosensitive layer thickness and the sensitivity) that changes with the use of the photosensitive drum 11 can be written and read at any time.

The developing roller 13 serving as a developing unit includes a metal core and a conductive elastic layer that is concentrically and integrally formed around the metal core. The developing roller 13 is arranged substantially parallel to the photosensitive drum 11. The developing blade 15 includes a thin metal plate made of stainless used steel (SUS). A free end of the developing blade 15 contacts the developing roller 13 with a predetermined pressing force. The developing roller 13 bears and conveys the toner charged with a negative polarity by friction to a development position facing the photosensitive drum 11. The developing roller 13 can be in a contact state or a separation state relative to the photosensitive drum 11 by a contact separation unit (not illustrated). In the course of image formation, the developing roller 13 contacts the photosensitive drum 11, so that a direct current (DC) bias voltage of approximately −300 V as a developing bias voltage is applied to the metal core of the developing roller 13 from a developing bias power source 601 (see FIG. 4).

The image forming apparatus 1 according to the present exemplary embodiment includes a laser exposure unit 20 serving as an exposure system (an exposure device, an exposure unit). The laser exposure unit 20 exposes the photosensitive drums 11Y, 11M, 11C, and 11K arranged in the respective process cartridges 10Y, 10M, 10C, and 10K to light. The laser exposure unit 20 receives a time-series electric digital pixel signal of image information that has been input to the control unit 100 from the controller 200 via the interface 201 and then undergone image processing. The laser exposure unit 20 includes a polygon mirror, an fθ lens, a reflection mirror, and a laser output unit for outputting a laser beam L that is modulated according to the input time-series electric digital pixel signal. The laser exposure unit 20 performs main-scanning exposure on a surface of the photosensitive drum 11 with the laser beam L (see FIG. 4). With such main scanning exposure and sub-scanning exposure that is performed by rotation of the photosensitive drum 11, an electrostatic latent image corresponding to the image information is formed.

The charging roller 12 serving as a contact-type charging unit includes a metal core and a conductive elastic layer that is concentrically and integrally formed around the metal core. The charging roller 12 is arranged substantially parallel to the photosensitive drum 11. Moreover, the charging roller 12 is in contact with the photosensitive drum 11 by a predetermined pressure force due to elasticity of the conductive elastic layer. Both ends of the metal core are rotatably supported by bearings, so that the charging roller 12 is rotated with rotation of the photosensitive drum 11. In the present exemplary embodiment, a charging bias voltage is applied to the metal core of the charging roller 12.

The image forming apparatus 1 according to the present exemplary embodiment includes an intermediate transfer belt 30 serving as a second image bearing member such that the intermediate transfer belt 30 contacts each of the process cartridges 10Y, 10M, 10C, and 10K. The intermediate transfer belt 30 includes an endless resin film having an electric resistance (a volume resistivity) of approximately 1011 to 1016 (Q·cm) and a thickness of 100 to 200 (μm). The intermediate transfer belt 30 can be made of a material such as polyvinylidene difluoride (PVDF), nylon, polyethylene terephthalate (PET), or polycarbonate (PC). Moreover, the intermediate transfer belt 30 is tightly stretched by a drive roller 34 and a secondary transfer counter roller 33. The intermediate transfer belt 30 is circularly driven at a process speed with rotation of the secondary transfer counter roller 33 by a motor (not illustrated). Each of primary transfer rollers 31Y, 31M, 31C, and 31K includes a roller having a conductive elastic layer on a shaft thereof. The primary transfer rollers 31Y, 31M, 31C, and 31K are arranged substantially parallel to the respective photosensitive drums 11Y, 11M, 11C, and 11K. The primary transfer rollers 31Y, 31M, 31C, and 31K are in contact with the respective photosensitive drums 11Y, 11M, 11C, and 11K by a predetermined pressure force with the intermediate transfer belt 30 therebetween. The primary transfer roller 31 serves as a transfer unit (a transfer member) for causing a toner image to be transferred from the photosensitive drum 11 to a transfer material. The shaft of the primary transfer roller 31 is provided such that application of a DC bias voltage having a positive-polarity forms a transfer electric field. In the present exemplary embodiment, the intermediate transfer belt 30 serves as the transfer material to which the toner image is transferred by the primary transfer roller 31. However, a toner image may be transferred to a recording medium (a sheet P) (the transfer material may be a recording medium). The developed toner image of each color on the photosensitive drum 11 is conveyed to a primary transfer position when the photosensitive drum 11 further rotates in a direction indicated by an arrow shown in FIG. 2. In the primary transfer position, the toner images on the respective photosensitive drums 11 are primarily transferred in sequence to the intermediate transfer belt 30 by the primary transfer electric fields formed between the primary transfer rollers 31 and the respective photosensitive drums 11. Here, since the images of the four colors are sequentially superimposed on the intermediate transfer belt 30, positions of these four toner images match one another. The drum cleaner 14 removes a primary transfer residual toner from the photosensitive drum 11. Operations of a color misregistration detection sensor 40 for detecting a toner image are described below.

A primary transfer bias power source 701 (see FIG. 4) applies a positive-polarity bias when the primary transfer processing is performed. Such a positive-polarity bias needs to be constantly controlled to an optimal value in consideration of environments and characteristics of parts so that the primary transfer processing is favorably performed while constantly satisfying conditions such as a high transfer efficiency and a low retransfer rate. In the present exemplary embodiment, such control is performed by a control unit (not illustrated).

The image forming apparatus 1 according to the present exemplary embodiment includes a sheet cassette 50, a pickup roller 51, a conveyance roller 52, and a registration roller 53 that serve as a sheet conveyance system on the sheet feeding side. The sheet cassette 50 stores sheets P. The pickup roller 51 picks up a sheet P serving as a recoding material from the sheet cassette 50 and convey the sheet P, at predetermined timing. The conveyance roller 52 conveys the sheet P fed by the pickup roller 51. The registration roller 53 is rotated according to the image forming operation, thereby feeding the sheet P to a secondary transfer position.

When the toner images of the four colors are primarily transferred to the intermediate transfer belt 30, the sheet P is conveyed from the registration roller 53 in synchronization with the rotation of the intermediate transfer belt 30. Then, a secondary transfer roller 32 having a configuration similar to that of the primary transfer roller 31 contacts the intermediate transfer belt 30 via the sheet P. A secondary transfer bias power source 702 (see FIG. 4) applies a positive-polarity bias to the secondary transfer roller 32 with the secondary transfer counter roller 33 as a counter electrode. The application of such a positive-polarity bias to the secondary transfer roller 32 secondarily transfers the four color toner images on the intermediate transfer belt 30 to the sheet P in a collective manner. A charging brash (not illustrated) being in contact with the intermediate transfer belt 30 applies a bias to a secondary transfer residual toner to provide a positive charge, so that the secondary transfer residual toner is transferred to the photosensitive drum 11 side in the primary transfer position of the image formation processing. Then, the secondary transfer residual toner is scraped and collected by the drum cleaner 14 from the photosensitive drum 11.

The sheet P with the transferred four color toner images is conveyed to a fixing device 60 by conveyance rollers 54 and 55. The fixing device 60 is a conventionally known fixing device. The fixing device 60 performs fixing processing in which heat and pressure are applied to the unfixed toner images on the sheet P, thereby fixing the toner images onto the sheet P. Subsequently, discharge rollers 56, 57, and 58 discharge the sheet P with the fixed images as a color image formed product from a discharge port to a discharge tray on the top surface of the apparatus body.

(1-2) Description of Laser Exposure Unit

Figure 9:
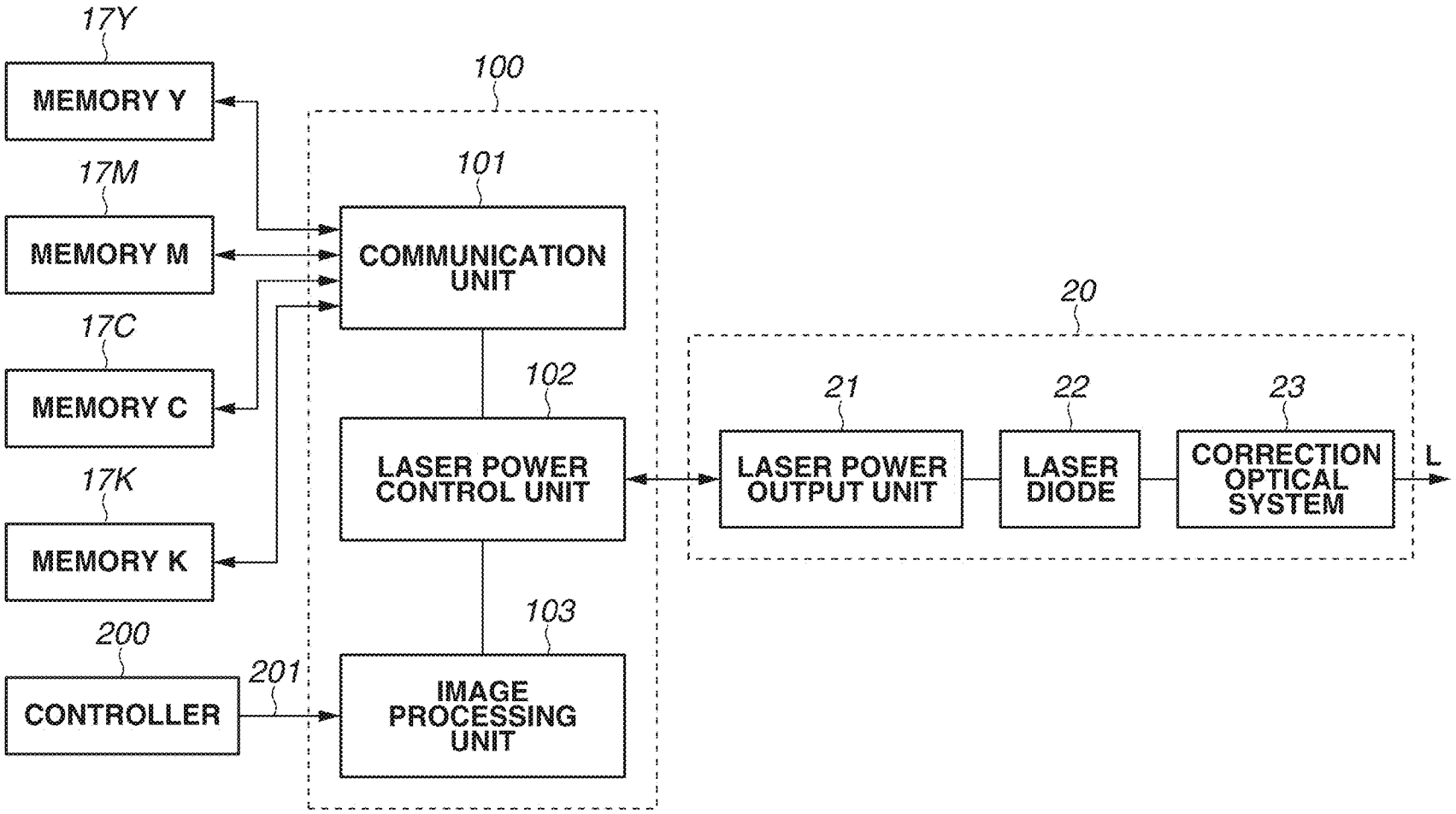
FIG. 9 is a block diagram illustrating a laser power control system according to the exemplary embodiment.

The laser exposure unit 20 according to the present exemplary embodiment is described with reference to FIG. 9 which is a block diagram illustrating a laser power control system. The laser exposure unit 20 according to the present exemplary embodiment is capable of switching between two output values of a first laser power E1 and a second laser power E2 as laser outputs used when the surface of the photosensitive drum 11 is exposed to light. That is, the control unit 100 includes a laser power control unit 102 for individually controlling the laser powers. Image signals transmitted from the controller 200 are multivalued signals (0 to 255) having a depth direction of 8 bits=256 gradations. If the image signal is 0, the laser beam is off. If the image signal is 255, the laser beam is fully on (fully lit). If the image signal falls in the range of 1 to 254, the laser beam has an intermediate value between those two for a while. In the present exemplary embodiment, an image processing unit 103 converts an image signal into a serial time-series digital signal, and uses area graduation in a 4×4 dither matrix and laser pulse width modulation to control the serial time-series digital signal in 256 levels. The laser pulse width modulation is performed by controlling laser emission time for dot pulses of 600 dots/inch. Moreover, the image processing unit 103 serving as an image information acquisition unit can acquire image density data corresponding to each color. For example, if image signals are yellow (Y) of 255 and magenta (M) of 255 in an area in which an image is present, the image processing unit 103 determines that a multicolor printing ratio in the area is 200%. Moreover, a communication unit 101 reads information about the photosensitive layer thickness and the sensitivity from the memories 17Y, 17M, 17C, and 17K of the respective process cartridges 10Y, 10M, 10C, and 10K. The laser power control unit 102 transmits a laser power signal and an image data signal to the laser exposure unit 20. The laser power signal is selected according to a state of each of the photosensitive drums 11 of the respective process cartridges 10, and the image data signal corresponds to each of the process cartridges 10. A laser power output unit 21 switches the laser powers according to the selected signal input from the laser power control unit 102 to cause a laser diode 22 to emit light. The photosensitive drum 11 is irradiated with such light as a laser scanning beam L via a correction optical system 23 including a polygon mirror.

The laser power control unit 102 according to the present exemplary embodiment individually controls the first laser power E1 and the second laser power E2 relative to each process cartridge 10. The first laser power E1 is used to form a dark area potential (a non-image area potential Vd) relative to a non-image area. The second laser power E2 is used to form a light area potential (an image area potential Vl) relative to an image area.

In the present exemplary embodiment, the image formation processing causes a predetermined bias current to flow to the laser diode 22, so that weak light is emitted. This is set as the first laser power E1. Moreover, the image forming processing causes the current with an increased current value to flow with respect to the image area, thereby providing the second laser power E2. Moreover, the laser power control unit 102 changes an amount of the current flowing to the laser diode 22 based on photosensitive member surface potential control described below, thereby controlling (adjusting) the laser power E1 and the second laser power E2.

(1-3) Description of Latent Image Setting

A latent image setting in the present exemplary embodiment is described with reference to FIGS. 3A and 3B. The photosensitive drum 11 according to the present exemplary embodiment includes a cylindrical base member made of aluminum, and an organic photoconductive (OPC) layer (an organic semiconductor) that covers the cylindrical base member. The photoconductive layer is also referred to as a photosensitive layer.

Figure 3A:
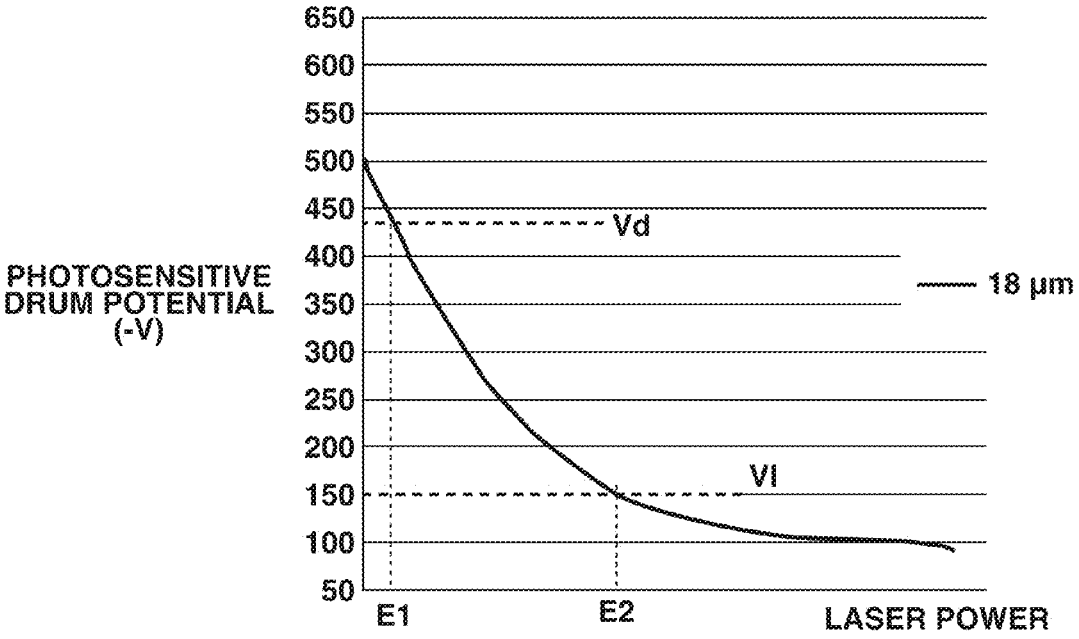
FIGS. 3A and 3B are diagrams illustrating a latent image setting according to the exemplary embodiment.

FIG. 3A is a graph illustrating a relationship between a surface potential and exposure laser power (hereinafter referred to as an E-V curve) when a DC voltage of approximately −1040 (V) is applied to the charging roller 12 relative to the photosensitive drum 11 in which a photosensitive layer has a thickness of 18 (μm). A horizontal axis on the graph indicates an exposure laser power E ($\mu J/cm^2$) that is received by a surface of the photosensitive member. The laser exposure unit 20 exposes an image portion on the photosensitive drum 11 to light with the second laser power E2 ($\mu J/cm^2$), thereby forming a light area potential (Vl) of approximately −150 (V). Simultaneously, the laser exposure unit 20 exposes a non-image area (background) to light with the first laser power E1 ($\mu J/cm^2$), thereby forming a dark area potential (Vd) of approximately −440 (V). Moreover, a DC bias voltage of approximately −300 (V) is applied to the developing roller 13. Accordingly, a negatively charged toner conveyed to a development position adheres to an area having the light area potential (Vl). This reversely develops the electrostatic latent image as a toner image. Such adhesion of the negatively charged toner is performed using a potential contrast between the light area potential (Vl) on the photosensitive drum 11 and a developing bias voltage (Vdc).

Figure 11A:
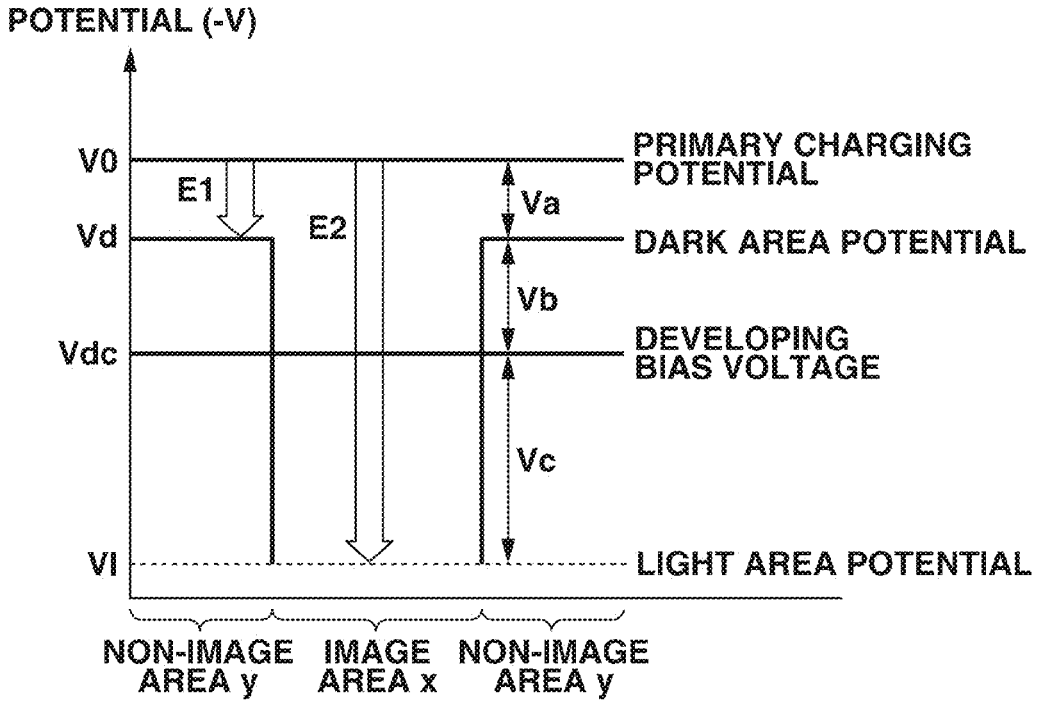
FIG. 11A is a diagram illustrating a potential of a photosensitive drum.
Figure 11B:
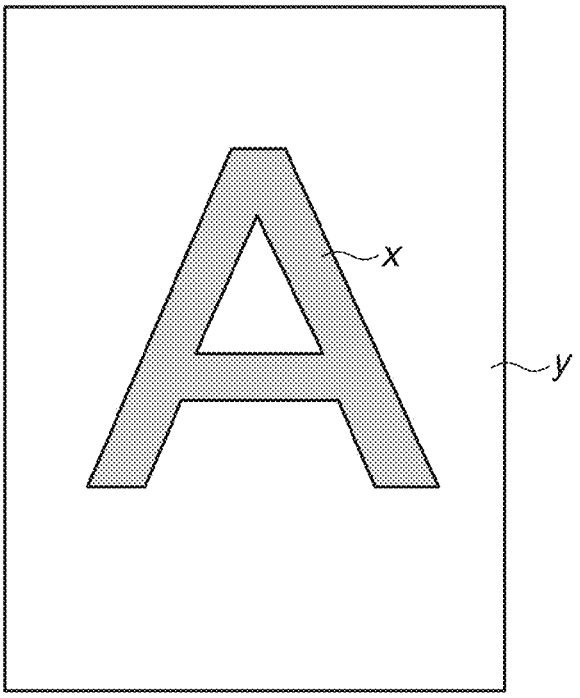
FIG. 11B is an expansion plan illustrating a surface of the photosensitive drum.

FIG. 11A illustrates a relationship between the photosensitive drum 11 including an image area x and a non-image area y and a potential of the photosensitive drum 11, whereas FIG. 11B schematically illustrates the image area x and the non-image area y of the photosensitive drum 11.

FIG. 11B is an expansion plan of a surface of the photosensitive drum 11, and illustrates a state in which a latent image of shape "A" is formed on the surface of the photosensitive drum 11. After the photosensitive drum 11 is exposed to light, the non-image area y is exposed to light with the first laser power (exposure power) E1, and the image area x is exposed to light with the second laser power (exposure power) E2. Hence, as illustrated in FIG. 11A, a potential of the photosensitive drum 11 which has been charged with V0 is attenuated (an absolute value of the potential is reduced). In the non-image area y exposed to the light with the first laser power E1, an absolute value of the potential is reduced by Va to Vd. On the other hand, in the image area x exposed to the light with the second laser power E2, an absolute value of the potential is reduced by Va+Vb+Vc to Vl.

The symbol "Vb" used herein represents a value indicating the difference between the non-image area potential (the dark area potential Vd) and the developing bias voltage Vdc. That is, the symbol "Vb" indicates back contrast. The back contrast (Vb) is a determinant of a fog (background soiling) amount in the non-image area y. Moreover, a development contrast (Vc) is a difference between the light area potential (Vl) and the developing bias voltage (Vdc). The development contrast (Vc) is a determinant for setting image density and graduation of the image area.

The image forming apparatus 1 according to the present exemplary embodiment uses the reversal development method by which the photosensitive drum 11 is negatively (minus) charged by the charging roller 12 and development is performed using a negatively (minus) charged toner. Therefore, an area exposed to light with the second laser power E2 ($\mu J/cm^2$) becomes an image area, whereas an area exposed to light with the first laser power E1 ($\mu J/cm^2$) becomes a blank area (background) serving as a non-image area.

(1-4) Description of Photosensitive Drum Potential Control

Figure 3B:
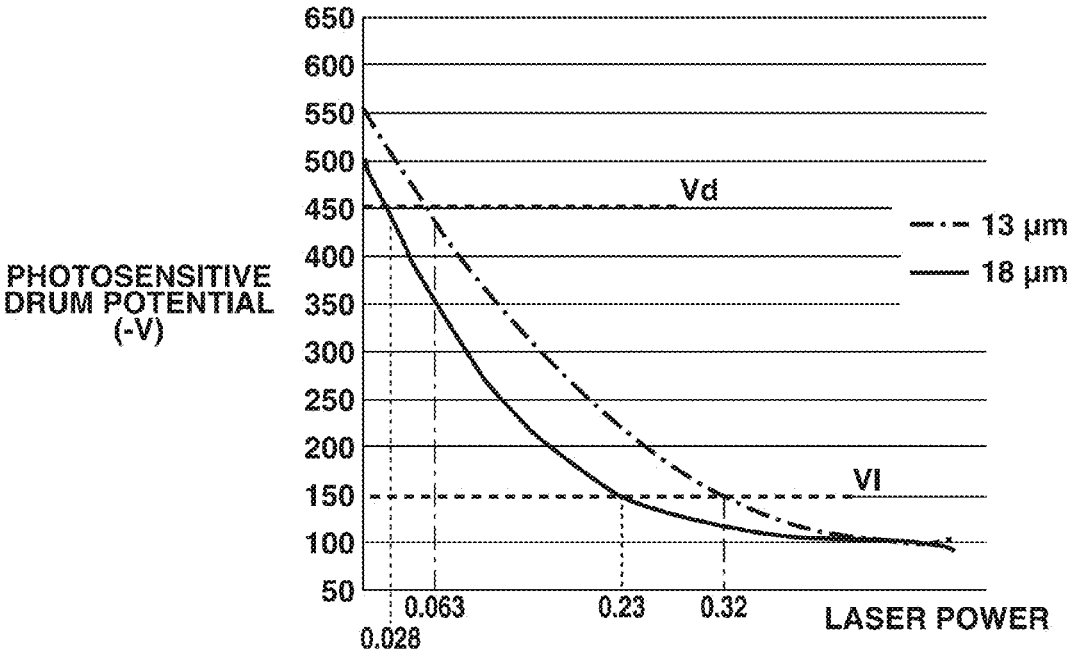

FIG. 3B is a diagram illustrating characteristic changes of an E-V curve of the photosensitive drum 11.

When print operations are performed, a photosensitive layer of the surface of the photosensitive drum 11 repeatedly undergoes discharge processing. Moreover, a surface of the photosensitive layer is abraded due to sliding friction by the drum cleaner 14 and the developing roller 13. As a result, a thickness of the photosensitive layer is reduced. This causes a change in the characteristic of the surface potential. As illustrated in FIG. 3B, if a charging application voltage value is fixed to a predetermined value, a primary charging potential is increased with the change in the thickness of the photosensitive layer. This is caused by a decrease in a discharge start voltage with an increase in capacitance, the discharge start voltage being applied between the charging roller 12 and the photosensitive drum 11. Specifically, if an output value of charging bias voltage is fixed to −1040 (V) and a photosensitive layer thickness is changed from 18 (μm) to 13 (μm), a charging potential increases from 500 (V) to 550 (V) as illustrated in the E-V curve of FIG. 3B. Accordingly, laser exposure output values for acquisition of a desired dark area potential Vd=−440 (V) and a desired light area potential Vl=−150 (V) are E1=0.028 ($\mu J/cm^2$) and E2=0.23 ($\mu J/cm^2$) if a layer thickness is 18 (μm). Moreover, E1=0.063 ($\mu J/cm^2$) and E2=0.32 ($\mu J/cm^2$) if a layer thickness is 13 (μm). Accordingly, the first and second laser powers E1 and E2 serving as laser exposure amounts are controlled based on the layer thickness information of the photosensitive member. This can maintain the stable dark area potential (Vd) and the stable light area potential (Vl) throughout the lifespan of the photosensitive member, thereby maintaining good image quality.

The layer thickness of the photosensitive drum 11 is determined by the control unit 100 according to an initial thickness of the photosensitive drum 11 and a used amount of the photosensitive drum 11, the initial thickness and the used amount being stored in the memory 17. As the used amount of the photosensitive drum 11 is greater, the layer thickness of the photosensitive drum 11 is more reduced. Thus, the control unit 100 determines how much change (reduction) has been made from the initial layer thickness to a current layer thickness. Here, a value to be expressed as the used amount of the photosensitive drum 11 can include the number of times the photosensitive drum has formed images (the number of times of image formation), and a total amount of rotations (an amount of time spent in rotations or the number of rotations), or a cumulative time for which voltage is applied to a process unit (e.g., the charging roller 12, the developing roller, and the transfer roller) that acts on the photosensitive drum 11.

According to the present exemplary embodiment, therefore, the first laser power E1 and the second laser power E2 serving as the laser exposure amounts are controlled to be increased according to the usage information (a change in the thickness of the photosensitive layer) of the photosensitive drum 11.

Figure 4:
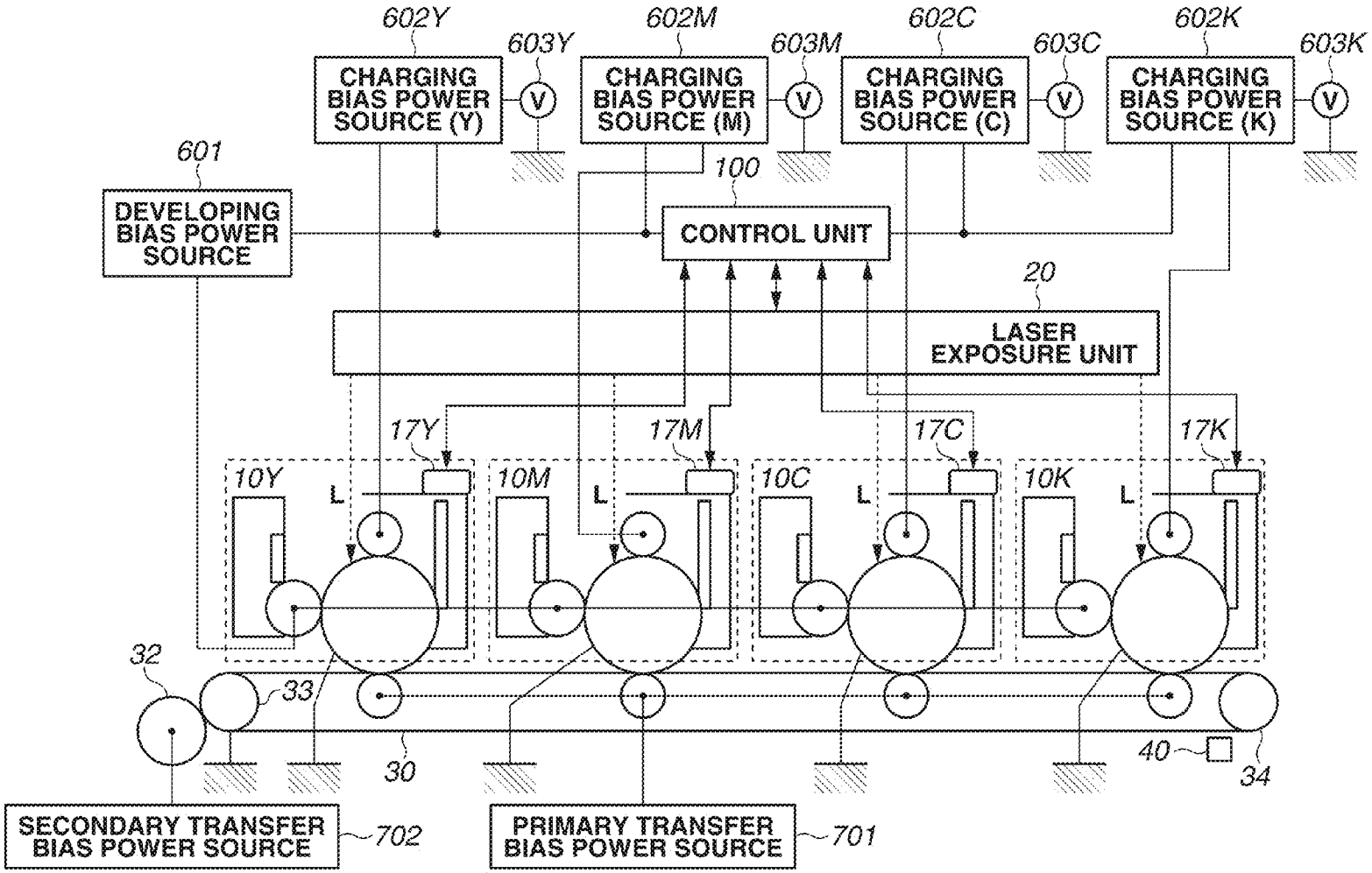
FIG. 4 is a diagram illustrating power supply wiring according to the exemplary embodiment.

(1-5) Description of Schematic Configuration of High-voltage Power Supply Circuit FIG. 4 is a wiring diagram illustrating connection of the developing bias power source 601 and charging bias power sources 602Y, 602M, 602C, and 602K to the process cartridges 10Y, 10M, 10C, and 10K according to the present exemplary embodiment. As illustrated in FIG. 4, the charging bias power sources 602Y, 602M, 602C, and 602K are connected to the charging rollers 12Y, 12M, 12C, and 12K of the process cartridges 10Y, 10M, 10C, and 10K, respectively. Moreover, current detection circuits 603Y, 603M, 603C, and 603K are provided between the respective charging bias power sources 602Y, 602M, 602C, and 602K and ground points. The current detection circuits 603Y, 603M, 603C, and 603K detect respective voltage values that are proportional to amounts of currents flowing from the charging bias power sources 602Y, 602M, 602C, and 602K to the charging rollers 12Y, 12M, 12C, and 12K, respectively. Moreover, the common developing bias power source 601 is connected to the developing rollers 13Y, 13M, 13C, and 13K of the respective process cartridges 10Y, 10M, 10C, and 10K. The developing bias power source 601 applies developing bias voltages of the same values to the developing rollers 13Y, 13M, 13C, and 13K. Similarly, a common primary transfer bias power source 701 is connected to the primary transfer rollers 31Y, 31M, 31C, and 31K. The primary transfer bias power source 701 applies primary transfer bias voltages of the same values to the primary transfer rollers 31Y, 31M, 31C, and 31K.

(1-6) Description of Color Misregistration Correction Control

The above-described image forming apparatus 1 first forms a mark (FIG. 6) for color misregistration detection on the intermediate transfer belt 30, and makes a correction such that a color misregistration amount is reduced. Subsequently, the image forming apparatus 1 forms electrostatic latent images on the photosensitive drums 11Y, 11M, 11C, and 11K with the corrected color misregistration amount. The image forming apparatus 1 detects a change in a charging current to measure a time when each of the electrostatic latent images reaches a position of the corresponding charging roller 12. Such a time is set as a reference value of the color misregistration correction control.

Then, the image forming apparatus 1 forms electrostatic latent images on the photosensitive drums 11Y, 11M, 11C, and 11K again in a color misregistration correction control performed when temperature inside the apparatus is changed due to, for example, continuous printing operation. The image forming apparatus 1 detects a change in a charging current to measure a time when each of the electrostatic latent images reaches a position of the corresponding charging roller 12. The image forming apparatus 1 compares such a time with the reference value to detect a color misregistration amount. The control unit 100 adjusts laser beam emission timing of the laser exposure unit 20 according to the detected color misregistration amount, so that the color misregistration amount is corrected. Such processing is described in detail below. The control of the image forming conditions regarding the color misregistration correction is not limited to the control of the laser emission timing. For example, a photosensitive drum speed may be controlled, or a mechanical position of a reflection mirror inside the laser exposure unit 20 may be adjusted to control the image forming conditions regarding the color misregistration.

(1-6-1) Flowchart of Reference Value Acquisition Processing

Figure 5:
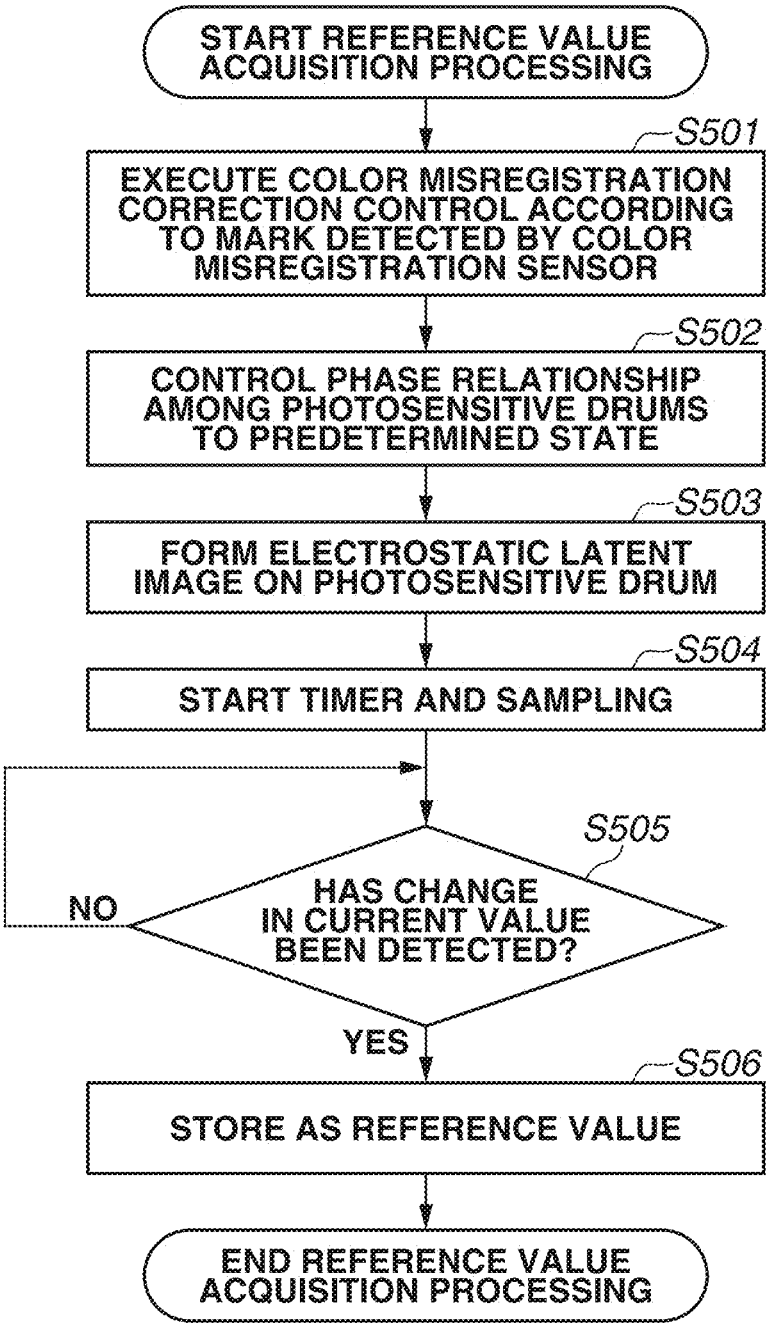
FIG. 5 is a flowchart illustrating control according to the exemplary embodiment.

FIG. 5 is a flowchart illustrating reference value acquisition processing performed in color misregistration correction control. The processing of the flowchart illustrated in FIG. 5 is executed subsequent to a color misregistration correction control (hereinafter referred to as a normal color misregistration correction control) performed based on the color misregistration detection mark (FIG. 6) detected by the color misregistration detection sensor 40 (toner image detection unit). Moreover, the processing of the flowchart illustrated in FIG. 5 may be executed for the normal color misregistration correction control at specific timing, for example, when the normal color misregistration correction control is executed upon replacement of a component of the developing roller 13 or the photosensitive drum 11. In addition, the processing of the flowchart illustrated in FIG. 5 is independently performed with respect to each color. The color misregistration detection sensor 40 includes a light emitting element such as a light emitting diode (LED). The color misregistration detection sensor 40 uses the light emitting element to irradiate a color misregistration detection toner image formed on the intermediate transfer belt 30 with light, and detects a change in light amount of reflected light therefrom. The color misregistration detection sensor 40 detects such a change in light amount as a position of the toner image (detection timing). Since this technique is conventionally known by many documents, a detailed description thereof is omitted.

[Step S501]

Figure 6:
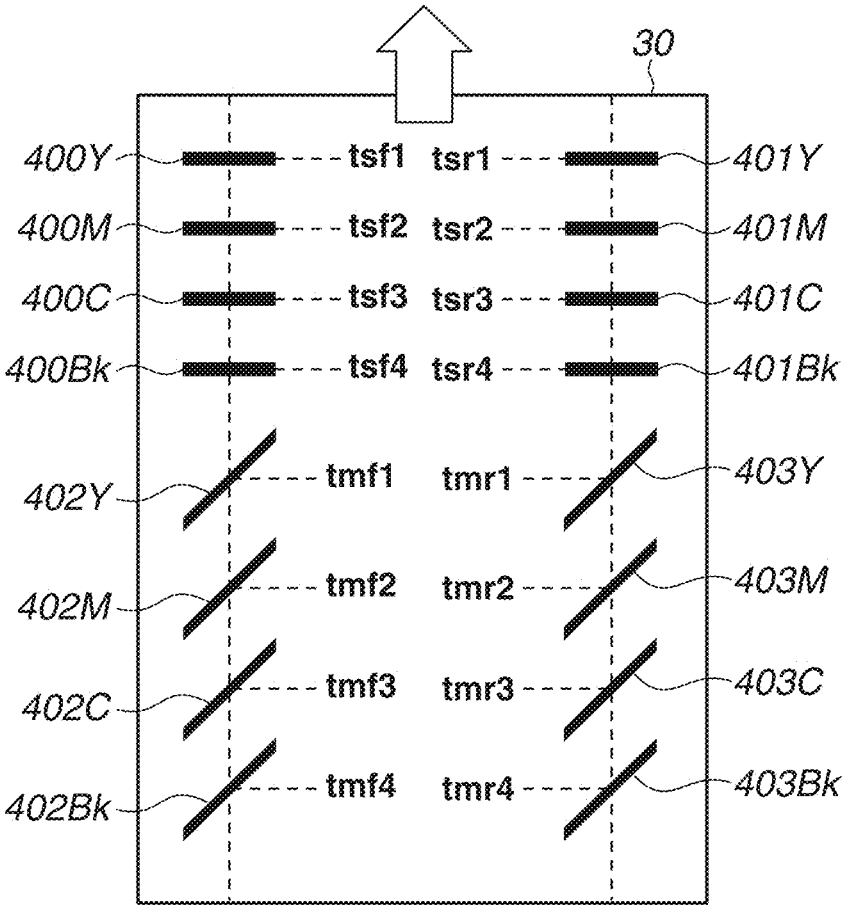
FIG. 6 is a schematic diagram illustrating toner marks for color misregistration correction according to the exemplary embodiment.

The control unit 100 causes the process cartridges 10 serving as image forming units to form toner marks for color misregistration detection on the intermediate transfer belt 30. Since the toner mark for color misregistration detection is a toner image (a developer image) used for color misregistration correction, it can be referred to as a color misregistration correction toner image (a color misregistration correction developer image). FIG. 6 illustrates formation of color misregistration detection toner marks. The processing in step S501 is referred to as the "normal color misregistration correction control" by which a color misregistration amount is reduced based on the mark detected by the color misregistration detection sensor 40.

Therefore, a state corrected by "the normal color misregistration correction control" is set to a target value, that is, a reference state, for the following "color misregistration correction control" performed using electrostatic latent images.

Next, the normal color misregistration correction control performed in step S501 is described.

In FIG. 6, patterns 400 and 401 are used to detect a color misregistration amount in a sheet conveyance direction (a sub-scanning direction, a direction perpendicular to an axis line of the photosensitive drum), whereas patterns 402 and 403 are used to detect a color misregistration amount in a main scanning direction perpendicular to the sheet conveyance direction. In FIG. 6, each of the patterns 402 and 403 is inclined at an angle of 45 degrees. Moreover, each of detection timing tsf 1 to tsf 4, tmf 1 to tmf 4, tsr 1 to tsr 4, and tmr 1 to tmr 4 indicates a time (a detection time) when the corresponding pattern is detected. A movement direction of the intermediate transfer belt 30 is indicated by an arrow illustrated in FIG. 6. Suffixes Y, M, C, Bk added to the reference numerals 400, 401, 402, and 403 indicate color of toners (yellow, magenta, cyan, and black) for forming the respective toner marks. For example, a pattern 400Y indicates a toner mark of yellow.

A movement speed of the intermediate transfer belt 30 is v (mm/s), a reference color is yellow (Y), and theoretical distances between a Y pattern and sheet conveyance direction patterns (400, 401) of respective colors are dsM (mm), dsC (mm), and dsBk (mm). A color misregistration amount δes of each color relative to a reference color of Y in a conveyance direction is expressed as Equations 1 through 3 as follows:

$$\delta esM = v \times \{(tsf2 - tsf1) + (tsr2 - tsr1)\}/2 - dsM \quad \text{Equation 1:}$$

$$\delta esC = v \times \{(tsf3 - tsf1) + (tsr3 - tsr1)\}/2 - dsC \quad \text{Equation 2:}$$

$$\delta esBk = v \times \{(tsf4 - tsf1) + (tsr4 - tsr1)\}/2 - dsBk \quad \text{Equation 3:}$$

Equations 1, 2, 3 are described by using Equation 1 as an example. In FIG. 6, a distance between the yellow toner pattern 400Y formed on the left side of the intermediate transfer belt 30 and the magenta toner pattern 400M formed on the left side of the intermediate transfer belt 30 is determined by v(tsf2−tsf1). Similarly, a distance between the yellow toner pattern 401Y formed on the right side of the intermediate transfer belt 30 and the magenta toner pattern 401M formed on the right side of the intermediate transfer belt 30 is determined by v (tsr2−tsr1).

Accordingly, an average value of the distances between the yellow toner patterns and the magenta toner patterns is v×{(tsf2−tsf1)+(tsr2−tsr1)}/2. This value indicates a measurement position of the magenta toner pattern where the yellow toner pattern serves as a reference position. On the other hand, a value (a theoretical distance from the yellow toner pattern to the magenta toner image) indicating a theoretical position of the magenta toner pattern is dsM where the yellow toner pattern serves as a reference position. Accordingly, a difference between the measurement value and the theoretical value is expressed as a color misregistration amount as Equation 1.

Color misregistration amounts δemf and δemr for each color on the right and left sides relative to a main scanning direction (an axial line direction of the photosensitive drum) are determined by following equations.

$$dmfY=v\times(tmf1-tsf1) \quad \text{Equation 4:}$$

$$dmfM=v\times(tmf2-tsf2) \quad \text{Equation 5:}$$

$$dmfC=v\times(tmf3-tsf3) \quad \text{Equation 6:}$$

$$dmfBk=v\times(tmf4-tsf4) \quad \text{Equation 7:}$$

and $$dmrY=v\times(tmr1-tsr1) \quad \text{Equation 8:}$$

$$dmrM=v\times(tmr2-tsr2) \quad \text{Equation 9:}$$

$$dmrC=v\times(tmr3-tsr3) \quad \text{Equation 10:}$$

$$dmrBk=v\times(tmr4-tsr4) \quad \text{Equation 11:}$$

Thus, $$\delta emfM=dmfM-dmfY \quad \text{Equation 12:}$$

$$\delta emfC=dmfC-dmfY \quad \text{Equation 13:}$$

$$\delta emfBk=dmfBk-dmfY \quad \text{Equation 14:}$$

and $$\delta emrM=dmrM-dmrY \quad \text{Equation 15:}$$

$$\delta emrC=dmrC-dmrY \quad \text{Equation 16:}$$

$$\delta emrBk=dmrBk-dmrY \quad \text{Equation 17:}$$

A misregistration direction can be determined based on a positive or negative value of a calculation result. A writing start position is corrected according to δemf, and a main scanning width (a main scanning magnification) is corrected according to δemr−δemf.

If there is an error in the main scanning width (main scanning magnification), the writing start position is calculated by considering not only δemf, but also an amount of change in an image frequency (image clock) that has been changed with the correction of the main scanning width.

The control unit 100 changes laser beam emission timing of the laser exposure unit 20 as an image forming condition such that the calculated color misregistration amount is eliminated. For example, if a color misregistration amount in a sub-scanning direction is an amount of −4 lines, the control unit 100 instructs the controller 200 to advance the laser beam emission timing by an amount of +4 lines.

In FIG. 6, the toner mark for color misregistration detection is formed on the intermediate transfer belt 30. However, various cases may be considered in terms of where to form the toner mark for color misregistration detection and whether to detect the toner mark by using an optical sensor (the color misregistration detection sensor 40). For example, a toner mark for color misregistration detection may be formed on the photosensitive drum 11, and a detection result provided by a color misregistration detection sensor (an optical sensor) arranged to be able to detect such a toner mark may be used. Alternatively, a toner mark for color misregistration detection may be formed on a sheet (a recording material), and a detection result provided by a color misregistration detection sensor (an optical sensor) arranged to be able to detect such a toner mark may be used. A toner mark for color misregistration detection can be formed on various transfer members or toner image bearing members.

[Step S502]

The control unit 100 adjusts a rotational phase relationship (a rotational position relationship) among the photosensitive drums 11Y, 11M, 11C, and 11K to a predetermined state to suppress influence exerted when rotational speeds (peripheral speeds) of the photosensitive drums 11Y, 11M, 11C, and 11K fluctuate. Specifically, the control unit 100 controls and adjusts phases of the photosensitive drums 11 of non-reference colors relative to a phase of the photosensitive drum 11 of the reference color. Moreover, in a case where a photosensitive drum driving gear is disposed to a shaft of the photosensitive drum 11, the control unit 100 substantially adjusts a phase relationship among the driving gears of the respective photosensitive drums 11.

Accordingly, when the toner images developed on the respective photosensitive drums 11 are transferred to the intermediate transfer belt 30, the photosensitive drums are rotated at substantially the same speed or fluctuations in speed of each of the photosensitive drums 11 tend to be similar. Specifically, the control unit 100 issues a speed control instruction to a motor (not illustrated) for driving the photosensitive drums 11 such that a rotational phase relationship among the photosensitive drums 11Y, 11M, 11C, and 11K is adjusted to a predetermined state. If the rotational speed fluctuations of the photosensitive drums 11 can be ignored, the processing in step S502 may be omitted.

[Step S503]

In processing from step S503 to step S506, the normal color misregistration correction control of step S501 sets a small color-misregistration state subjected to correction as a target value of subsequent color misregistration correction control. That is, a state corrected by the normal color misregistration correction control is stored as a reference value by using an electrostatic latent image.

The control unit 100 causes the laser exposure unit 20 to emit laser beams to form electrostatic latent images for color misregistration correction (for detection) on the respective photosensitive drums 11 in a predetermined rotational phase, the photosensitive drums 11 being rotated with surfaces thereof charged beforehand.

Figure 8A:
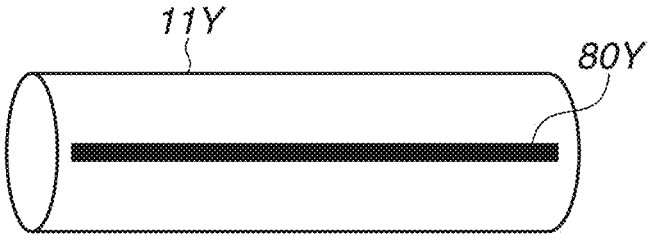
FIGS. 8A and 8B are diagrams illustrating an electrostatic latent image for color misregistration correction and changes in current value according to the exemplary embodiment.

In FIG. 8A, an electrostatic latent image 80Y for detection is formed on the photosensitive drum 11. The electrostatic latent image 80Y is formed as wide as possible in an image region width in a main scanning direction, and has a width of approximately 5 lines in a conveyance direction. In a width in the main scanning direction, an electrostatic latent image having a width greater than or equal to a longitudinal width of the charging roller 12Y is desirably formed to enhance detection accuracy.

Here, for example, the developing roller 13Y and the primary transfer roller 31Y are separated (a separation state) from the photosensitive drum 11. This allows the electrostatic latent image 80Y to be conveyed to a position of the charging roller 12 without adhesion of toner to the electrostatic latent image 80Y or attenuation of a potential.

Such control may be performed when the developing roller 13Y and the primary transfer roller 31Y are in contact with the photosensitive drum 11Y. In such a case, the control unit 100 controls a voltage to be output from each of the developing bias power source 601 and the primary transfer bias power source 701 to zero. Alternatively, the control unit 100 may perform voltage control such as application of a bias having a polarity opposite to that normally applied. Such control prevents adhesion of toner to the electrostatic latent image 80Y and attenuation of the potential of the electrostatic latent image 80Y.

[Step S504]

The control unit 100 starts timers at the same time or substantially the same time as the processing in step S503, the timers being provided for Y, M, C, and K. Moreover, the control unit 100 starts sampling of current values of the current detection circuits 603Y, 603M, 603C, and 603K. Herein, a sampling frequency is 10 kHz, for example.

[Step S505]

Each of the current detection circuits 603Y, 603M, 603C, and 603K detects a current to measure an arrangement of the electrostatic latent image formed on the photosensitive drum 11. That is, when the electrostatic latent image formed on the photosensitive drum 11 reaches an area facing the charging roller 12, the current flowing between the photosensitive drum 11 and the charging roller 12 changes. Detection of such change timing can determine a location of the electrostatic latent image on the photosensitive drum 11. Here, the charging roller 12 serves as a detection device for measuring a position of the electrostatic latent image.

Figure 8B:
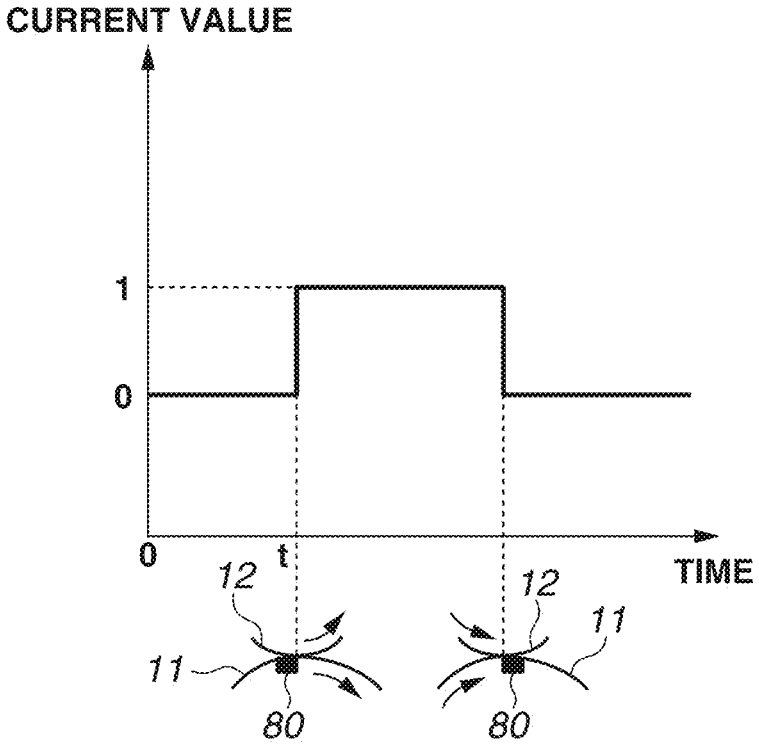

The control unit 100 measures times (timer values) when changes in the current values are detected. The current values change in the current detection circuits (current measurement devices) 603Y, 603M, 603C, and 603K when the electrostatic latent images 80Y, 80M, 80C, and 80Y formed in step S503 reach positions facing the charging rollers (detection devices) 12Y, 12M, 12C, and 12K, respectively. FIG. 8B illustrates one example of the detection result. In the present exemplary embodiment, the image forming apparatus 1 uses a method for detecting the current value change by binarization using a predetermined threshold value.

In FIG. 8B, a position (area) of the current value change corresponds to a position in which the electrostatic latent image 80 moves and reaches an area of gap (void) serving as small space on an upstream side and a downstream side of a nip formed between the photosensitive drum 11 and the charging roller 12. In the present exemplary embodiment, a time measured based on a time when the timer is started in step S504 is zero. A time t represents a time of the current value change when the electrostatic latent image 80 enters into the upstream gap between the photosensitive drum 11 and the charging roller 12. This time t is a value indicating a position of the electrostatic latent image.

[Step S506]

Lastly, the control unit 100 stores the time t (the timer value) measured in step S505 in a memory (not illustrated) inside thereof as a reference value. The information stored here indicates a reference state that serves as a target when the color misregistration correction control is performed. When performing the color misregistration correction control, the control unit 100 attempts to eliminate a deviation from the reference state. In other words, the control unit 100 performs the color misregistration correction control such that the state deviating from the reference state returns to the reference state.

Therefore, when the control unit 100 performs the color misregistration control hereafter, the control unit 100 makes an adjustment such that a position of an electrostatic latent image to be formed on each of the photosensitive drums 11 returns to the electrostatic latent image reference position determined in step S505. This reference position determined in step S505 serves as a position that is set to reduce the color misregistration by the normal color misregistration correction control performed in step S501.

When a current value change is detected in a case where the reference value (the time t indicating the reference position of the electrostatic latent image) is acquired in steps S503 through S506, a charging bias condition and an exposure condition may not necessarily be the same as those applied when a normal image is output. Similarly, when a current value change is detected in color misregistration correction control (in steps S101 through S109 described below), a charging bias condition and an exposure condition may not necessarily be the same as those applied when a normal image is output.

That is, when a normal image (an image of print data transmitted from the controller 200 of the external device such as a host computer) is output, various bias conditions and exposure conditions are set such that a toner amount on paper is suitable. Such control of the toner amount on paper suppresses generation of a poor-quality image due to, for example, toner scattering and poor toner fixing.

However, when the reference value is acquired or the color misregistration correction control is performed, such a toner amount on paper does not need to be controlled (as a toner image is not transferred to paper). Consequently, a setting enabling a current value change to be detected with higher accuracy may be used, instead of the setting for controlling the toner amount on paper. Moreover, when an electrostatic latent image is formed, a surface of the photosensitive drum 11 is irradiated with a laser beam. The use of the photosensitive drum 11 for long periods may deteriorate sensitivity of the photosensitive member. Thus, the laser power in the electrostatic latent image formation needs to be optimized.

According to the present exemplary embodiment, therefore, when a reference value is acquired, and when color misregistration correction control is performed, bias conditions and exposure conditions differ from those used when a normal image is output.

Figure 7A:
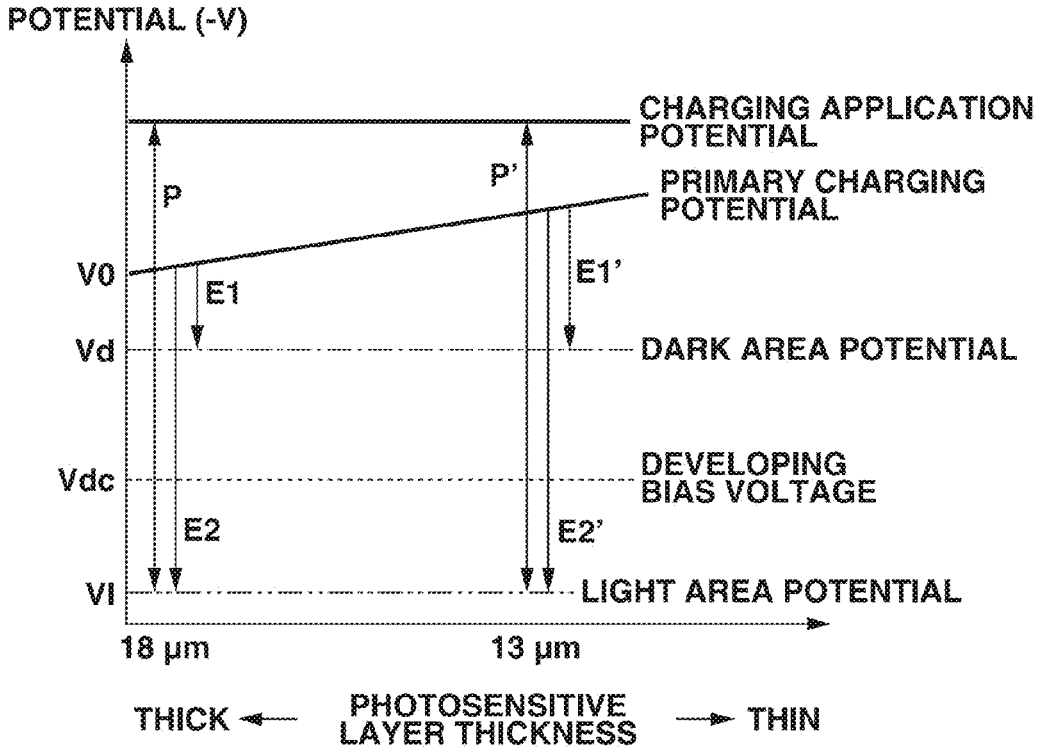
FIGS. 7A and 7B are schematic diagrams illustrating laser power control according to the exemplary embodiment.
Figure 7B:
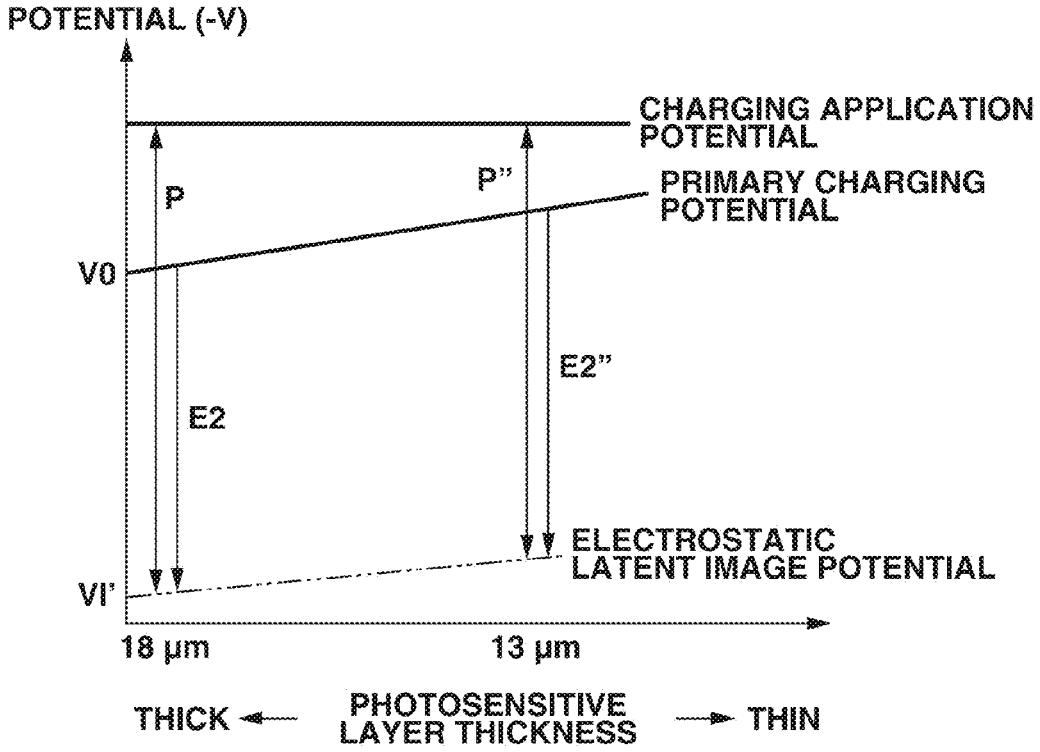

FIG. 7A is a schematic diagram illustrating a surface potential of the photosensitive drum 11 when normal image formation is performed. FIG. 7B is a schematic diagram illustrating a surface potential of the photosensitive drum 11 when color misregistration correction control is performed, according to the present exemplary embodiment. In FIG. 7B, the same reference numerals are allocated to elements similar to those in FIG. 7A, and redundant descriptions thereof are omitted. Hereinafter, a description of control performed in the color misregistration correction control is given.

In the normal image formation as described above, in a case where a layer thickness of the photosensitive drum 11 is reduced with the use of the photosensitive drum 11, increases in the first laser power E1 and the second laser power E2 control a dark area potential and a light area potential to be kept constant. That is, the reduction in the layer thickness of the photosensitive drum 11 allows the photosensitive drum 11 to be charged more easily by the charging roller 12 (an absolute value of a primary charging potential increases). Thus, after being charged, the photosensitive drum 11 is irradiated with a high-intensity laser beam to adjust a potential thereof to a desired value.

In practice, as illustrated in FIG. 7A, the following relationships apply.

$$E1<E1'$$

$$E2<E2'$$

where E1 and E2 respectively are a first laser power and a second laser power used if a layer thickness of the photosensitive drum is 18 μm, and E1' and E2' respectively are a first laser power and a second laser power used if a layer thickness of the photosensitive drum is 13 μm.

Meanwhile, it is assumed that a case where electrostatic latent images for color misregistration correction control are formed by using the laser powers E2 and E2' for the normal image formation, that is, the electrostatic latent images are formed such that an electrostatic latent image potential is Vl. Here, as illustrated in FIG. 7A, a potential difference between a potential applied to the charging roller 12 (a charging application potential) and a potential of the electrostatic latent image (a light area potential Vl) is constant (P=P') regardless of the layer thickness. However, in a case where the layer thickness is 13 μm, a charging current flowing to a charging power source when an electrostatic latent image reaches a position facing the charging roller 12 is greater than that where the layer thickness is 18 μm.

This is caused by the fact that a surface charge density is higher when a drum layer thickness is smaller in spite of the same surface potentials. Accordingly, in a case where a layer thickness of the photosensitive drum 11 is changed, the current flowing between the photosensitive drum 11 and the charging roller 12 (the current flowing to the charging power source) is not constant in spite of constant electrostatic latent image potential (the light area potential Vl).

Therefore, when the color misregistration correction control is performed, a potential of a detection electrostatic latent image is desirably changed according to a layer thickness of the photosensitive drum 11, unlike the image formation. With such a change, detection accuracy of current value changes at the time of color misregistration correction control is maintained constant throughout the lifespan of the photosensitive member. Moreover, adjustment of an exposure amount according to a change in the layer thickness of the photosensitive member can prevent the photosensitive member from being over-exposed to light and suppress deterioration in sensitivity of the photosensitive member due to light-induced fatigue.

In the present exemplary embodiment, as schematically illustrated in FIG. 7B, the second laser power E2 in the formation of a detection electrostatic latent image is reduced to E2" with the reduction in the layer thickness of the photosensitive drum (E2'>E2>E2").

Consequently, if the layer thickness is reduced, an absolute value of an electrostatic latent image potential (Vl') is controlled to be greater. That is, the thinner the layer, the smaller the difference between the electrostatic latent image potential (Vl') and the potential of the charging roller 12 (a charging application potential). Therefore, detection current values in the color misregistration correction control are controlled to be substantially constant.

In the present exemplary embodiment, a relationship (look-up table (LUT)) between the layer thickness and the second laser power E2 is provided such that the detection current values are substantially constant. Such a relationship is stored in the control unit 100 beforehand. When the color misregistration correction control is executed, layer thicknesses of the photosensitive members are read from the respective memories 17Y, 17M, 17C, and 17K of the process cartridges to determine the second laser power E2 for electrostatic latent image formation.

In the present exemplary embodiment, the charging application voltage and the second laser power E2 for electrostatic latent image formation for color misregistration correction where a layer thickness is 18 μm are used in a setting that is substantially the same as that used in the normal image formation. However, values of the charging application voltage and the second laser power E2 may be increased to enhance detection accuracy of current value changes while considering deterioration in sensitivity of the photosensitive member. Even in such a case, the laser power in the electrostatic latent image formation is reduced with the reduction in the layer thickness of the photosensitive member, as similar to the above control. In the present exemplary embodiment, moreover, the current value change at the time of color misregistration correction control is detected by binarization using a threshold value. However, the present exemplary embodiment is not limited thereto. The current value change may be detected by other methods.

Moreover, the present exemplary embodiment has been described using the example case in which the charging roller 12 serves as a process unit (a detection device) for detecting a current value change based on a potential difference relative to an electrostatic latent image. However, an element to be used as the detection device is not limited thereto. A developing unit (the developing roller 13: see FIG. 2) serving as a process unit or the primary transfer roller 31 (see FIG. 2) may be used as the detection device. In such a case, an advantage similar to the above can be achieved.

That is, when the color misregistration correction electrostatic latent image formed on each of the photosensitive drums reaches a position facing the developing roller 12 or the primary transfer roller 31, a current value change that occurs in each of the power source units is detected so that color misregistration correction control can be performed. That is, a position of the electrostatic latent image formed on the photosensitive drum 11 can be identified by detecting a change in value of the current flowing to the developing bias power source 601 or the primary transfer bias power source 701 (see FIG. 4). This allows control of a position in which an electrostatic latent image is to be formed on the photosensitive drum 11 (adjustment can be made such that the position is arranged near the reference position).

(1-6-2) Flowchart of Color Misregistration Correction Control

Figure 1:
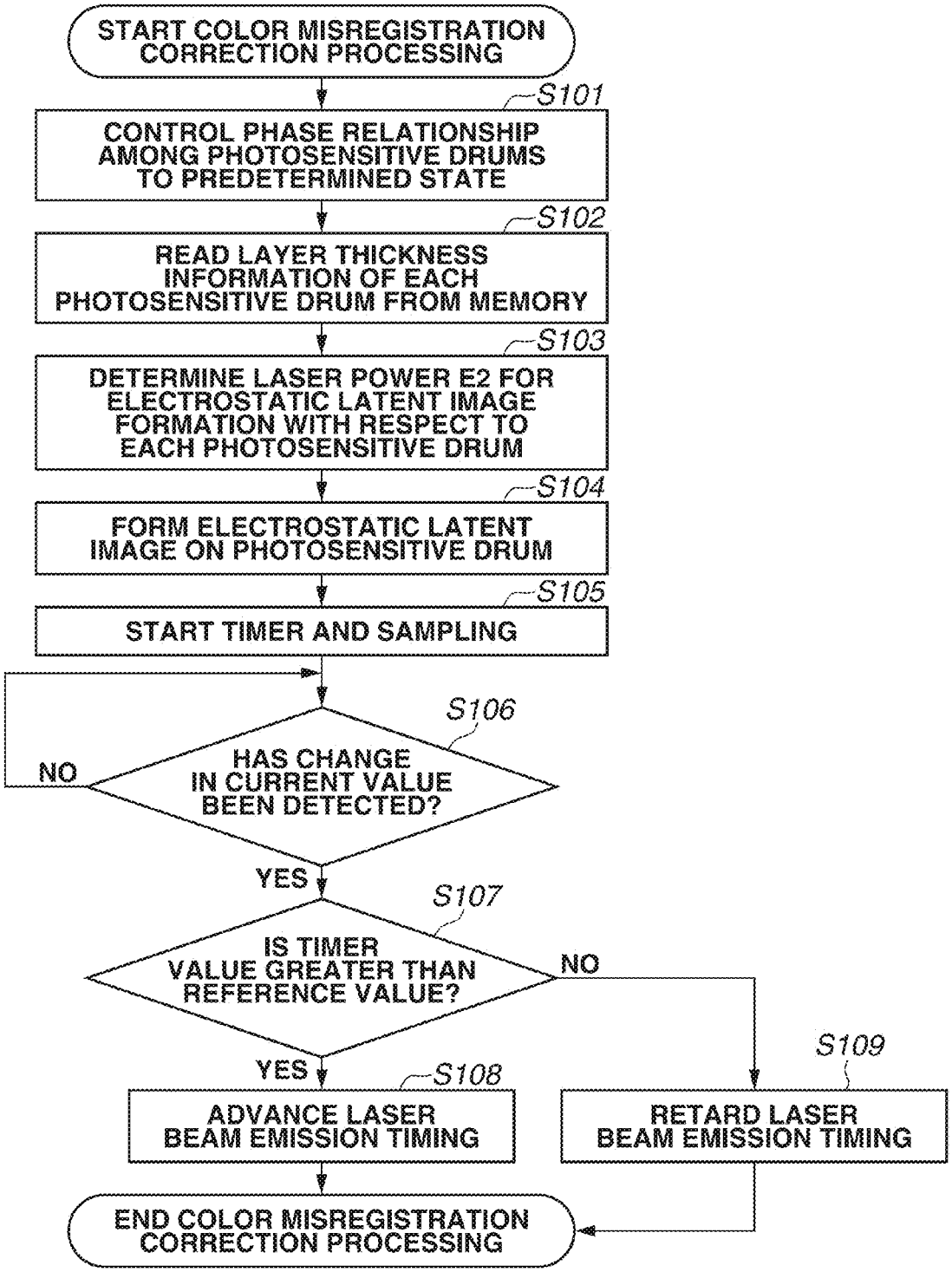
FIG. 1 is a flowchart illustrating control according to an exemplary embodiment.

Next, color misregistration correction control according to the present exemplary embodiment is described with reference to flowchart illustrated in FIG. 1. Processing in the flowchart illustrated in FIG. 1 is independently performed with respect to each color. Moreover, as described above, the processing in the flowchart illustrated in FIG. 1 is executed under predetermined conditions. The predetermined conditions include a case where temperature inside the apparatus is changed due to, for example, continuous printing operation, a case where an instruction for execution of the color misregistration correction control illustrated in FIG. 1 is input to the control unit 100 by a user, and a case where environment inside the apparatus is significantly changed. Alternatively, the image forming apparatus 1 may be configured such that a user can select whether the color misregistration correction control should be executed.

[Step S101]

The control unit 100 performs processing similar to that performed in step S502 of the flowchart illustrated in FIG. 5.

[Step S102 Through Step S103]

The control unit 100 acquires layer thickness information of the photosensitive drum from the memory 17 of the process cartridge 10, and determines the second laser power E2 for electrostatic latent image formation according to the layer thickness of the photosensitive drum based on the LUT stored in the control unit 100 beforehand.

[Step S104 Through Step S106]

The control unit 100 performs processing similar to that performed in steps S503 through S505 of the flowchart illustrated in FIG. 5.

[Step S107 Through Step S109]

The control unit 100 measures a timer value t of a current value change relative to each photosensitive drum 11, and compares the timer value t with a stored reference value. If the timer value t is greater than the reference value (Yes in step S107), the processing proceeds to step S108. In step S108, the control unit 100 corrects laser beam emission timing that is an image forming condition so as to advance the laser beam emission timing of print operation. The control unit 100 determines a setting of how much to advance the laser beam emission timing. Such a setting may be adjusted by how large the measured time t is compared to the reference value.

On the other hand, if the detected timer value t is smaller than the reference value (NO in step S107), the processing proceeds to step S109. In step S109, the control unit 100 retards the laser beam emission timing of print operation. The control unit 100 determines a setting of how much to retard the laser beam emission timing. Such a setting may be adjusted by how small the measured time t is compared to the reference value. The image forming condition correction processing performed in steps S108 and S109 corrects color misregistration. That is, a state of the current color misregistration can return to a reference color misregistration state (a reference state).

Therefore, the color misregistration correction control performed in steps S101 through S109 serves as an exposure adjustment mode for adjusting light emission timing at which the exposure unit emits light in the image formation, to predetermined timing. In the adjustment mode (steps S101 through S109), an electrostatic latent image for detection is formed on the photosensitive drum 11, and the current detection circuit (a measurement unit) 603 measures changes in the current flowing to the charging roller 12 (a detection device). The control unit 100 can appropriately determine light emission timing to be used in the image formation based on such current change timing. That is, the adjustment mode can also be called a detection mode in which the detection electrostatic latent image is detected by the current detection circuit (the measurement unit) 603.

In the color misregistration correction control (the exposure adjustment mode) in steps S101 through S109, adjustment of the light emission timing in the image formation enables an electrostatic latent image to be formed in a desired position of the photosensitive drum. This can suppress misregistration (correct color misregistration) of toner images of respective colors formed on a plurality of photosensitive drums 11.

Moreover, in the processing in steps S101 through S109 described above, as a layer thickness of the photosensitive drum 11 is more reduced (a layer is thinner), a potential difference between the detection electrostatic latent image and the charging roller (the detection device) 12 is smaller. This can prevent the current flowing to the charging roller 12 from becoming excessively large even if a surface charge density of the photosensitive drum 11 tends to be higher by reduction in the layer thickness of the photosensitive drum 11. That is, even if a layer thickness of the photosensitive drum 11 is changed, fluctuations in the current flowing to the charging roller can be suppressed when the color misregistration correction control (the exposure adjustment mode) is executed. Moreover, in a case where the layer thickness is reduced, the photosensitive drum 11 can be prevented from being exposed to excess light, thereby suppressing deterioration in sensitivity of the photosensitive drum 11.

In the color misregistration correction control (the exposure adjustment mode) performed in steps S101 through S109 according to the present exemplary embodiment, the second laser power (exposure power) E2 for formation of a detection electrostatic latent image is lower as a layer thickness is more reduced. However, the second laser power (exposure power) E2 is not necessarily lower as a layer thickness is more reduced. Since a primary charging potential of the photosensitive drum 11 tends to be greater as a layer thickness of the photosensitive drum 11 is more reduced (see FIG. 7B), an appropriate laser power can be accordingly selected such that the potential difference between the detection electrostatic latent image and the charging roller (the detection device) 12 is reduced.

As a layer thickness of the photosensitive drum 11 is more reduced (see FIG. 7A), the second laser power E2 used to form an electrostatic latent image in the normal image formation is greater, unlike the case where the color misregistration correction control (the exposure adjustment mode) is executed. That is, when the normal image formation is performed, a potential difference between the charging application potential and the electrostatic latent image potential (the light area potential) is greater as the layer thickness is more reduced. Since a change in the electrostatic latent image potential is desirably suppressed in the normal image formation, the potential difference is increased.

In step S107 of the flowchart illustrated in FIG. 1, the control unit 100 compares the timer value at the time of detection of the current value change with the reference value stored in step S506 of the flowchart illustrated in FIG. 5. However, the processing in step S107 is not limited thereto. That is, in an optional color misregistration state, the processing in steps S502 through S506 may be executed, and the stored reference value may be used as a comparison target of the processing in step S107 from a standpoint in which the color misregistration state at a certain time is maintained.

According to the present exemplary embodiment, the layer thickness information of the photosensitive member is used to determine the laser power for formation of a detection electrostatic latent image in the color misregistration correction control. However, in addition to the layer thickness information of the photosensitive member, sensitivity characteristic of the photosensitive member or usage history of the photosensitive member may be used as information about the photosensitive member. The sensitivity characteristic of each of the photosensitive members derives from manufacturing. Since such sensitivity characteristic affects an electrostatic latent image potential of the color misregistration correction control, the color misregistration can be corrected with higher accuracy by considering sensitivity information. Moreover, in a case where sensitivity of the photosensitive member is changed by frequency of laser exposure, the control unit 100 can count an exposure history to apply the change in sensitivity to the laser power in the formation of detection electrostatic latent image. This can extend the lifespan of the photosensitive member, and further enhance accuracy of the color misregistration correction.

Moreover, the present exemplary embodiment has been described using the color image forming apparatus, which includes a plurality of photosensitive drums 11, as an image forming apparatus. The color image forming apparatus performs the processing in steps S101 through S109 of the flowchart illustrated in FIG. 1 described above, thereby achieving an advantage of color misregistration suppression. However, the exposure adjustment mode (steps S101 through S109) can be applied to a monochrome image forming apparatus including a single photosensitive drum 11.

In the monochrome image forming apparatus, since toner images of different colors are not superimposed to form an image, color misregistration does not occur. However, even in the monochrome image forming apparatus, a change in position in which an electrostatic latent image is formed may cause misregistration of an image relative to a recording medium (a sheet P). Thus, control processing such as the processing in steps S101 through S109 can be considered to adjust light emission timing of an exposure device so that such misregistration is suppressed.

Figure 10:
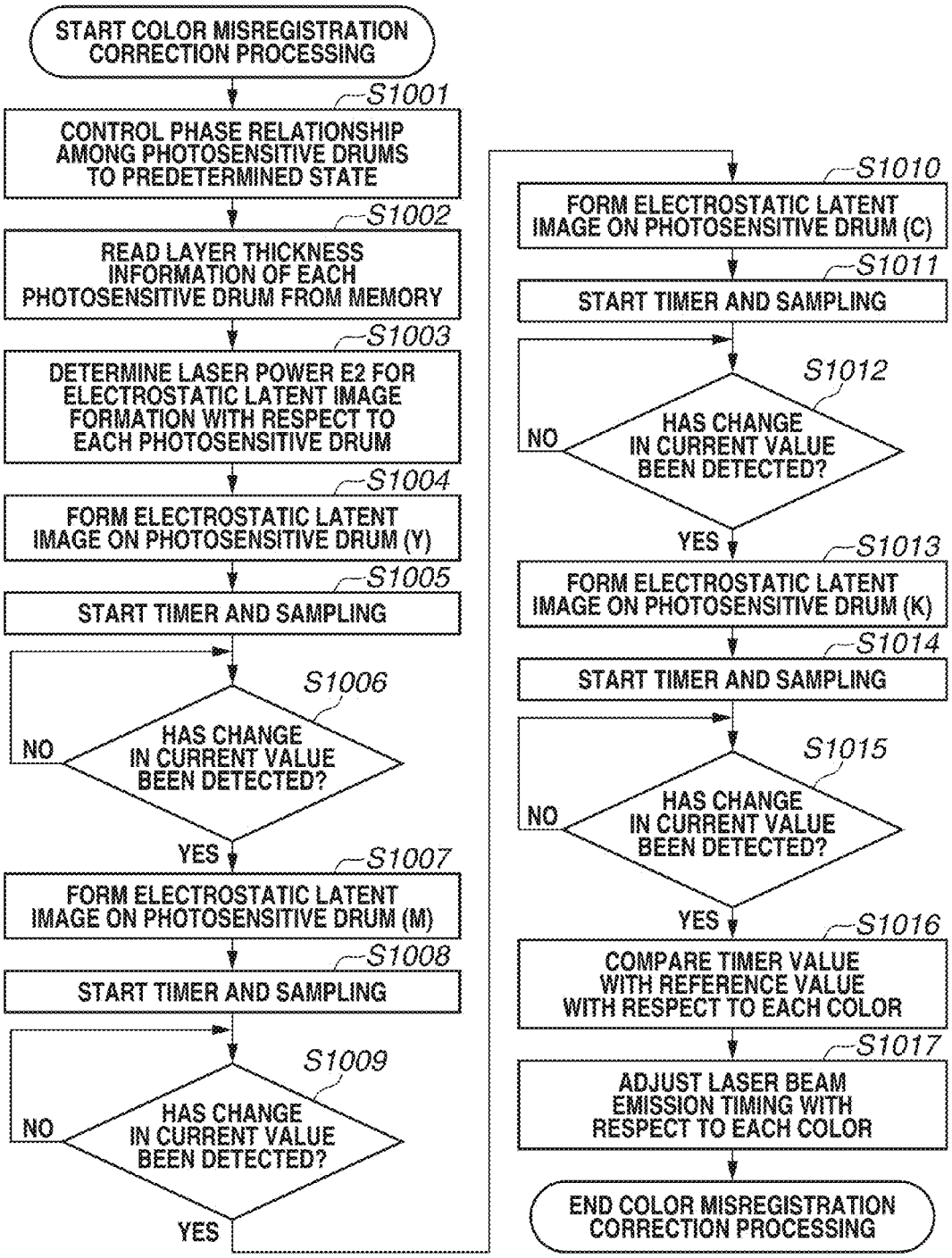
FIG. 10 is a flowchart illustrating color misregistration correction processing according to an exemplary embodiment.

A second exemplary embodiment is described. FIG. 10 is a flowchart illustrating color misregistration correction processing according to a second exemplary embodiment. Components and configurations that are substantially the same as those of the first exemplary embodiment will be given the same reference numerals as above and description thereof will be omitted. Unlike the image forming apparatus illustrated in FIG. 4, the image forming apparatus of the second exemplary embodiment includes a common charging bias power source 602 that applies the same charging voltage to charging rollers 12Y, 12M, 12C, and 12K for charging surfaces of respective photosensitive drums 11Y, 11M, 11C, and 11K.

In such a configuration, a charging current detection circuit serves as a common circuit. Thus, when color misregistration correction control is performed, electrostatic latent images need to be formed on the respective photosensitive drums 11 in order.

Drum potential control, latent image control, and color misregistration reference value acquisition processing are similar to those described in the first exemplary embodiment.

(2-1) Flowchart of Color Misregistration Correction Control

A description of color misregistration correction control according to the present exemplary embodiment is given with reference to a flowchart of FIG. 10. The color misregistration correction control is executed under predetermined conditions as similar to the first exemplary embodiment. The predetermined conditions include a case where temperature inside the apparatus is changed due to, for example, continuous printing operation, a case where an instruction for execution of the color misregistration correction control illustrated in FIG. 1 is input to a control unit 100 by a user, and a case where environment inside the apparatus is significantly changed. [Steps S1001 through step S1003]

The control unit 100 performs control processing similar to that in steps S101 through S103 of the flowchart illustrated in FIG. 1.

[Steps S1004 Through Step S1015]

The control unit 100 executes control processing similar to that in steps S104 through S106 of the flowchart illustrated in FIG. 1 with respect to each of the colors in order.

[Steps S1016 Through Step S1017]

The control unit 100 executes control processing similar to that in steps S107 through S109 of the flowchart illustrated in FIG. 1 for each color.

According to the second exemplary embodiment, employment of the common charging power source can not only contribute to size reduction and cost reduction of the apparatus, but also enables the color misregistration correction to be executed with accuracy.

According to the above-described exemplary embodiments, an electrostatic latent image for detection can be formed while suppressing sensitivity deterioration of the photosensitive member.

While aspects of the present invention have been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-203415, filed Oct. 1, 2014, which is hereby incorporated by reference herein in its entirety.

What is claimed is:

1. An image forming apparatus forming an image on a recording medium, the image forming apparatus comprising:

a photosensitive member configured to be rotated;

an exposure device configured to expose the photosensitive member to light to form an electrostatic latent image on the photosensitive member;

a detection device to which a voltage is applied;

a measurement device configured to measure a current flowing to the detection device; and a control unit configured to execute a detection mode in which an electrostatic latent image is formed on the photosensitive member and the measurement device detects a change of the current when the electrostatic latent image reaches a detecting area facing the detection device, wherein, in the detection mode, the control unit causes a potential difference between the electrostatic latent image and the detection device to be smaller as a layer thickness of a photosensitive layer of the photosensitive member is more reduced.

2. The image forming apparatus according to claim 1, wherein an exposure power for formation of the electrostatic latent image in the detection mode is lower than an exposure power for formation of an electrostatic latent image in image formation.

3. The image forming apparatus according to claim 1, wherein a difference between an exposure power for formation of the electrostatic latent image in the detection mode and an exposure power for formation of an electrostatic latent image in image formation is greater as the layer thickness of the photosensitive layer of the photosensitive member is more reduced.

4. The image forming apparatus according to claim 1, wherein, in the detection mode, the control unit causes an exposure power for formation of the electrostatic latent image to be lower as the layer thickness of the photosensitive layer of the photosensitive member is more reduced.

5. The image forming apparatus according to claim 1, wherein, in image formation, the control unit causes an exposure power for formation of the electrostatic latent image to be greater as the layer thickness of the photosensitive layer of the photosensitive member is more reduced.

6. The image forming apparatus according to claim 1, wherein an absolute value of a potential of the electrostatic latent image formed in the detection mode is greater as the layer thickness of the photosensitive layer of the photosensitive member is more reduced.

7. The image forming apparatus according to claim 1, wherein the image forming apparatus includes a plurality of photosensitive members and a plurality of detection devices, wherein toner images formed on the plurality of photosensitive members are superimposed to form an image.

8. The image forming apparatus according to claim 7, wherein the plurality of detection devices receive same voltages from a common power source.

9. The image forming apparatus according to claim 1, wherein the detection device is a charging member that charges the photosensitive member when the image forming apparatus performs image formation.

10. The image forming apparatus according to claim 1, wherein the detection device is a developer bearing member that bears developer to supply the developer to the electrostatic latent image formed on the photosensitive member.

11. The image forming apparatus according to claim 1, wherein the detection device is a transfer member that transfers a developer image formed on the photosensitive member to a transfer material.

12. The image forming apparatus according to claim 1, further comprising a storage member storing information about the photosensitive member, wherein, in the detection mode, an exposure power for formation of the electrostatic latent image on the photosensitive member is determined based on the information stored in the storage member.

13. The image forming apparatus according to claim 12, wherein the control unit determines the layer thickness of the photosensitive layer of the photosensitive member based on an initial layer thickness of the photosensitive layer and a used amount of the photosensitive member, the initial layer thickness and the used amount being information stored in the storage member.

14. The image forming apparatus according to claim 13, wherein the used amount of the photosensitive member is determined based on at least one of the number of times of image formation, a total amount of rotation of the photosensitive member, or a cumulative application time of the voltage applied to the detection device.

15. The image forming apparatus according to claim 1, wherein the control unit determines, based on current change timing of a change in the current measured by the measurement device in the detection mode, light emission timing of the exposure device in image formation.

16. An image forming apparatus forming an image on a recording medium, the image forming apparatus comprising:

a photosensitive member configured to be rotated;

an exposure device configured to expose the photosensitive member to light to form an electrostatic latent image on the photosensitive member;

a detection device to which a voltage is applied;

a measurement device configured to measure a current flowing to the detection device; and a control unit configured to execute a detection mode in which an electrostatic latent image is formed on the photosensitive member and the measurement device detects a change of the current when the electrostatic latent image reaches a detecting area facing the detection device, wherein an exposure power for formation of the electrostatic latent image in the detection mode is lower than an exposure power for formation of an electrostatic latent image in image formation.

17. The image forming apparatus according to claim 16, wherein a difference between the exposure power for formation of the electrostatic latent image in the detection mode and the exposure power for formation of the electrostatic latent image in the image formation is greater as a layer thickness of a photosensitive layer of the photosensitive member is more reduced.

18. The image forming apparatus according to claim 16, wherein, in the detection mode, the control unit causes the exposure power for formation of the electrostatic latent image to be lower as the layer thickness of the photosensitive layer of the photosensitive member is more reduced.

19. The image forming apparatus according to claim 16, wherein, in the image formation, the control unit causes the exposure power for formation of the electrostatic latent image to be greater as the layer thickness of the photosensitive layer of the photosensitive member is more reduced.

20. The image forming apparatus according to claim 16, wherein an absolute value of a potential of the electrostatic latent image formed in the detection mode is greater as the layer thickness of the photosensitive layer of the photosensitive member is more reduced.

21. The image forming apparatus according to claim 16, wherein the image forming apparatus includes a plurality of photosensitive members and a plurality of detection devices, wherein toner images formed on the plurality of photosensitive members are superimposed to form an image.

22. The image forming apparatus according to claim 21, wherein the plurality of detection devices receive same voltages from a common power source.

23. The image forming apparatus according to claim 16, wherein the detection device is a charging member that charges the photosensitive member when the image forming apparatus performs image formation.

24. The image forming apparatus according to claim 16, wherein the detection device is a developer bearing member that bears developer to supply the developer to the electrostatic latent image formed on the photosensitive member.

25. The image forming apparatus according to claim 16, wherein the detection device is a transfer member that transfers a developer image formed on the photosensitive member to a transfer material.

26. The image forming apparatus according to claim 16, further comprising a storage member storing information about the photosensitive member, wherein, in the detection mode, the exposure power for formation of the electrostatic latent image on the photosensitive member is determined based on the information stored in the storage member.

27. The image forming apparatus according to claim 26, wherein the control unit determines the layer thickness of the photosensitive layer of the photosensitive member based on an initial layer thickness of the photosensitive layer and a used amount of the photosensitive member, the initial layer thickness and the used amount being information stored in the storage member.

28. The image forming apparatus according to claim 27, wherein the used amount of the photosensitive member is determined based on at least one of the number of times of image formation, a total amount of rotation of the photosensitive member, and a cumulative application time of the voltage applied to the detection device.

29. The image forming apparatus according to claim 16, wherein the control unit determines, based on current change timing of a change in the current measured by the measurement device in the detection mode, light emission timing of the exposure device in image formation.

* * * * *